US005486300A

United States Patent [19]

Salomon et al.

[11] Patent Number: 5,486,300

[45] Date of Patent: Jan. 23, 1996

[54] LUBRICATING COMPOSITIONS

[75] Inventors: Mary F. Salomon, Mayfield Village; Kirk E. Davis, Chester Township; Jack L. Karn, Richmond Heights; John M. Cahoon, Mentor, all of Ohio

[73] Assignee: The Lubrizol Corporation, Wickliffe, Ohio

[21] Appl. No.: 278,344

[22] Filed: Jul. 21, 1994

Related U.S. Application Data

[63] Continuation of Ser. No. 688,195, Apr. 19, 1991, abandoned.

[51] Int. Cl.[6] ..... C10M 125/00

[52] U.S. Cl. ..... 252/18; 252/32.7 E; 252/45; 252/50; 252/51.5 A; 252/51.5 R; 252/52 R

[58] Field of Search ..... 252/18, 50, 51.5 A, 252/32, 32.5, 33, 41, 32.7 R, 56 D

[56] References Cited

U.S. PATENT DOCUMENTS

| | | | |
|---|---|---|---|
| 2,298,660 | 10/1942 | Stevens | 252/52 R |
| 2,316,080 | 4/1943 | Loane et al. | 252/48 |
| 2,316,082 | 4/1943 | Loane et al. | 252/48 |
| 2,921,901 | 1/1960 | Karll et al. | 252/32.7 |
| 3,003,959 | 10/1961 | Wilson et al. | 252/32.7 |
| 3,042,613 | 7/1962 | Lemmon et al. | 252/32.7 |
| 3,127,348 | 3/1964 | Versteeg | 252/32.7 |
| 3,182,019 | 5/1965 | Wilks et al. | 252/32.7 |
| 3,271,310 | 9/1966 | LeSuer | 252/41 |
| 3,377,282 | 4/1968 | Bell | 252/32.7 |
| 3,562,159 | 2/1971 | Mastin | 252/32.7 |
| 3,654,152 | 4/1972 | Corringer et al. | 252/32.7 |
| 4,234,435 | 11/1980 | Meinhardt | 252/51.5 |
| 4,283,294 | 8/1981 | Clarke | 252/32.7 |
| 4,326,972 | 4/1982 | Chamberlain | 252/33.3 |
| 4,528,108 | 7/1985 | Grover | 252/75 |
| 4,579,666 | 4/1986 | Schroeck | 252/32.7 E |
| 4,867,890 | 9/1989 | Colclough et al. | 252/32.7 |
| 4,904,401 | 2/1990 | Ripple et al. | 252/32.7 |
| 4,938,881 | 7/1990 | Ripple et al. | 252/32.7 |
| 4,952,328 | 8/1990 | Davis | 252/33.4 |
| 4,957,649 | 9/1990 | Ripple et al. | 252/32.7 |
| 4,981,602 | 1/1991 | Ripple et al. | 252/32.7 |

FOREIGN PATENT DOCUMENTS

| | | |
|---|---|---|
| 1055700 | 9/1974 | Canada . |
| 0309105 | 3/1989 | European Pat. Off. . |
| 0330523 | 8/1989 | European Pat. Off. . |
| 0465118 | 1/1992 | European Pat. Off. . |
| 0482759 | 4/1992 | European Pat. Off. . |

OTHER PUBLICATIONS

McGeehan, "Some Effects of Zinc Dithiophosphates and Detergents on Controlling Engine Wear", SAE, 1986, pp. 879–892.

*Primary Examiner*—Ellen M. McAvoy
*Attorney, Agent, or Firm*—Frederick D. Hunter

[57] ABSTRACT

This invention relates to a lubricating oil composition, comprising:

a major amount of an oil of lubricating viscosity; and (A) an amount of at least one alkali metal overbased salt of an acidic organic compound sufficient to provide at least about 0.005 equivalents of alkali metal per 100 grams of the lubricating composition;

(B) at least about 1.13% by weight of at least one dispersant;

(C) at least one metal dihydrocarbyl dithiophosphate; and (D) at least one antioxidant, provided that the lubricating oil composition is free of calcium overbased sulfonate; provided that the composition contains less than about 0.08% by weight calcium; and provided that (C) and (D) are not the same.

45 Claims, No Drawings

LUBRICATING COMPOSITIONS

This is a continuation of application Ser. No. 07/688,195 filed on Apr. 19, 1991, now abandoned.

FIELD OF THE INVENTION

This invention relates to lubricating oil compositions containing overbased alkali metal salts of at least one acidic organic compound, at least one dispersant, at least one metal dithiophosphate and at least one antioxidant.

INTRODUCTION TO THE INVENTION

As engines, specifically spark-ignited and diesel engines, preferably spark-ignited engines, have increased in power output and complexity, the performance requirements of lubricating oils have been increased to provide lubricating oils that exhibit a reduced tendency to deteriorate under conditions of use and thereby to reduce wear and the formation of such undesirable deposits as varnish, sludge, carbonaceous materials and resinous materials which tend to adhere to various engine parts and reduce efficiency of engines.

Alkaline earth metal detergents, usually overbased calcium or magnesium sulfonates are used to suspend degradation products in oils and to neutralize acidic contaminants within the oils. These alkaline earth metal detergents generally are basic, and, when excess metallic base is present as metal carbonate, titrate to bromophenol blue indicator which has an acid end point at a pH of approximately 3.0–4.2.

Alkali metal detergents are useful in the present lubricating compositions to provide improved detergency. The alkali metal detergents provide a stronger inorganic basic component (usually metal carbonate) in an oil-soluble form than alkaline earth metal detergents. The alkali metal detergents titrate basic to both bromophenol blue and phenolphthalein indicators. Phenolphthalein has a basic transition point at a pH of approximately 8.2–10. Therefore alkali metal detergents have a stronger base component, e.g., alkali metal carbonate, than alkaline earth metal detergents. The stronger base component acts to improve neutralization of acid by-products in the oil. The inventors have discovered that lubricating compositions containing the combination of an alkali metal detergent with a metal dithiophosphate, dispersant and an antioxidant have improved performance.

Canadian Patent 1,055,700 relates to basic alkali sulfonate dispersions and processes. U.S. Pat. No. 4,326,972 relates to concentrates, lubricant compositions and methods for improving fuel economy of internal combustion engines. These compositions have as an essential ingredient a specific sulfurized composition and a basic alkali metal sulfonate. U.S. Pat. No. 4,904,401 relates to lubricating oil compositions. These compositions may contain a basic alkali metal salt of at least one sulfonic or carboxylic acid. U.S. Pat. No. 4,938,881 relates to lubricating oil compositions and concentrates. These compositions and concentrates include at least one basic alkali metal salt of sulfonic or carboxylic acid. U.S. Pat. No. 4,952,328 relates to lubricating oil compositions. These compositions contain from about 0.01% to about 2% by weight of at least one basic alkali metal salt of sulfonic or carboxylic acid.

SUMMARY OF THE INVENTION

This invention relates to a lubricating oil composition, comprising:

a major amount of an oil of lubricating viscosity; and (A) an amount of at least one alkali metal overbased salt of an acidic organic compound sufficient to provide at least about 0.005 equivalents of alkali metal per 100 grams of the lubricating composition;

(B) at least about 1.13% by weight of at least one dispersant;

(C) at least one metal dihydrocarbyl dithiophosphate; and (D) at least one antioxidant, provided that the lubricating oil composition is free of calcium overbased sulfonate; provided that the composition contains less than about 0.08% by weight calcium; and provided that (C) and (D) are not the same.

DETAILED DESCRIPTION OF THE INVENTION

The term "hydrocarbyl" includes hydrocarbon, as well as substantially hydrocarbon, groups. Substantially hydrocarbon describes groups which contain non-hydrocarbon substituents which do not alter the predominately hydrocarbon nature of the group.

Examples of hydrocarbyl groups include the following:

(1) hydrocarbon substituents, that is, aliphatic (e.g., alkyl or alkenyl), alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, that is, those substituents containing non-hydrocarbon groups which, in the context of this invention, do not alter the predominantly hydrocarbon substituent; those skilled in the art will be aware of such groups (e.g., halo (especially chloro and fluoro), hydroxy, alkoxy, mercapto, alkylmercapto, nitro, nitroso, sulfoxy, etc.);

(3) hetero substituents, that is, substituents which will, while having a predominantly hydrocarbon character within the context of this invention, contain other than carbon present in a ring or chain otherwise composed of carbon atoms. Suitable heteroatoms will be apparent to those of ordinary skill in the art and include, for example, sulfur, oxygen, nitrogen and such substituents as, e.g., pyridyl, furyl, thienyl, imidazolyl, etc. In general, no more than about 2, preferably no more than one, non-hydrocarbon substituent will be present for every ten carbon atoms in the hydrocarbyl group. Often there will be no such non-hydrocarbon substituents in the hydrocarbyl group and the hydrocarbyl group is purely hydrocarbon.

Throughout this specification and claims, references to percentages by weight of the various components are on a chemical basis unless otherwise indicated. An equivalent weight of an amine or a polyamine is the molecular weight of the amine or polyamine divided by the total number of nitrogens present in the molecule. The number of equivalents of the acylating agent depends on the total number of carboxylic functions present. The equivalent weight of a hydroxyamine used to form carboxylic ester derivatives is its molecular weight divided by the number of hydroxyl groups present, and the nitrogen atoms present are ignored. An equivalent weight of a hydroxy-substituted amine to be reacted with the acylating agents to form carboxylic amine derivatives is its molecular weight divided by the total number of nitrogen groups present in the molecule. An equivalent weight of polyhydric alcohol is its molecular weight divided by the total number of hydroxyl groups present in the molecule.

The terms "substituent" and "acylating agent" or "substituted succinic acylating agent" are to be given their normal meanings. For example, a substituent is an atom or group of atoms that has replaced another atom or group in a molecule as a result of a reaction. The term acylating agent or substituted succinic acylating agent refers to the compound per se and does not include unreacted reactants used to form the acylating agent or substituted succinic acylating agent.

A) Alkali Metal Overbased Salts:

The present lubricating compositions contain A) an alkali metal overbased salt of an acidic organic compound. The overbased salts are single phase, homogeneous, Newtonian systems characterized by a metal content in excess of that which would be present according to the stoichiometry of the metal and the particular organic compound reacted with the metal. The amount of excess metal is commonly expressed in terms of metal ratio. The term "metal ratio" is the ratio of the total equivalents of the metal to the equivalents of the acidic organic compound. A salt having 4.5 times as much metal as present in a normal salt will have metal excess of 3.5 equivalents, or a ratio of 4.5. In the present invention, these salts preferably have a metal ratio from about 1.5 to about 40, preferably about 3 to about 30, more preferably about 3 to about 25.

The overbased materials are prepared by reacting an acidic material, typically carbon dioxide, with a mixture comprising an acidic organic compound, a reaction medium comprising at least one inert, organic solvent for said acidic organic compound, a stoichiometric excess of the metal compound, typically a metal hydroxide or oxide, and a promoter. In another embodiment, the basic alkali metal salts are prepared by reacting water with a mixture comprising an acidic organic compound, a reaction medium and a promoter. These metal salts and methods of making the same are described in U.S. Pat. No. 4,627,928. This disclosure is hereby incorporated by reference.

The acidic organic compounds are selected from the group consisting of carboxylic acids, sulfonic acids, phosphorus acids, phenols and derivatives thereof. Preferably, the overbased materials are prepared from carboxylic acids or sulfonic acids. The carboxylic and sulfonic acids may have substituent groups derived from polyalkenes. The polyalkene is characterized as containing from at least about 8 carbon atoms, preferably at least about 30, more preferably at least about 35 up to about 300 carbon atoms, preferably up to about 200, more preferably up to about 100. In one embodiment, the polyalkene is characterized by an $\overline{M}n$ (number average molecular weight) value of at least about 400, preferably about 500. Generally, the polyalkene is characterized by an $\overline{M}n$ value of about 500, preferably about 700, more preferably about 800, still more preferably about 900 up to about 5000, preferably up to about 2500, more preferably up to about 2000, still more preferably up to about 1500. In another embodiment $\overline{M}n$ varies between about 500, preferably about 700, more preferably about 800 up to about 1200 or 1300.

The abbreviation $\overline{M}n$ is the conventional symbol representing number average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC.

The techniques for determining $\overline{M}n$ and $\overline{M}w$ values of polymers are well known and are described in numerous books and articles. For example, methods for the determination of $\overline{M}n$ and molecular weight distribution of polymers is described in W. W. Yan, J. J. Kirkland and D. D. Bly, "Modern Size Exclusion Liquid Chromatographs", J Wiley & Sons, Inc., 1979.

The polyalkenes include homopolymers and interpolymers of polymerizable olefin monomers of 2 to about 16 carbon atoms; usually 2 to about 6, preferably 2 to about 4, more preferably 4. The olefins may be monoolefins such as ethylene, propylene, 1-butene, isobutene, and 1-octene; or a polyolefinic monomer, preferably diolefinic monomer, such 1,3-butadiene and isoprene. Preferably, the interpolymer is a homopolymer. An example of a preferred homopolymer is a polybutene, preferably a polybutene in which about 50% of the polymer is derived from isobutylene. The polyalkenes are prepared by conventional procedures.

Suitable carboxylic acids from which useful alkali metal salts can be prepared include aliphatic, cycloaliphatic and aromatic mono- and polybasic carboxylic acids free from acetylenic unsaturation, including naphthenic acids, alkyl- or alkenyl-substituted cyclopentanoic acids, and alkyl- or alkenyl-substituted cyclohexanoic acids, preferably alkenyl-substituted succinic acids or anhydrides. The aliphatic acids generally contain from about 8 to about 50, and preferably from about 12 to about 25 carbon atoms. The cycloaliphatic and aliphatic carboxylic acids are preferred, and they can be saturated or unsaturated.

Illustrative carboxylic acids include 2-ethylhexanoic acid, palmitic acid, stearic acid, myristic acid, oleic acid, linoleic acid, behenic acid, hexatriacontanoic acid, tetrapropylene substituted glutaric acid, polybutenyl substituted succinic acid derived from polybutene ($\overline{M}n$ equals about 200–1500, preferably about 300–1500, more preferably about 800–1200), polypropylenyl substituted succinic acid derived from polypropene ($\overline{M}n$ equals about 200–2000, preferably 300–1500, more preferably about 800– 1200), acids formed by oxidation of petrolatum or of hydrocarbon waxes, commercially available mixtures of two or more carboxylic acids such as tall oil acids, and rosin acids, octadecyl-substituted adipic acid, chlorostearic acid, 9-methylstearic acid, dichlorostearic acid, stearylbenzoic acid, eicosane-substituted naphthoic acid, dilauryl-decahydro-naphthalene carboxylic acid, and mixtures of these acids, their metal salts, and/or their anhydrides.

In another embodiment, the carboxylic acid is an alkyloxyalkylene-acetic acid or alkylphenoxy-acetic acid, more preferably alkylpolyoxyalkylene-acetic acid or salts thereof. Some specific examples of these compounds include: isostearylpentaethyleneglycolacetic acid; isostearyl-O—$(CH_2CH_2O)_5CH_2CO_2Na$; lauryl-$O(CH_2CH_2O)_{2.5}CH_2CO_2H$; lauryl-O—$(CH_2CH_2O)_{3.3}CH_2CO_2H$; oleyl-$O(CH_2CH_2O)_4CH_2CO_2H$; lauryl-O—$(CH_2\text{-}CH_2O)_{4.5}CH_2CO_2H$; lauryl-$O(CH_2CH_2O)_{10}CH_2CO_2H$; lauryl-O—$(CH_2CH_2O)_{16}$-$CH_2CO_2H$; octyl-phenyl-O—$(CH_2CH_2O)_8CH_2CO_2H$; octyl-phenyl-O—$(CH_2CH_2O)_{19}CH_2CO_2H$; 2-octyldecanyl-$O(CH_2CH_2O)_6CH_2\ CO_2\ H$. These acids are available commercially from Sandoz Chemical under the tradename Sandopan acids.

In one preferred embodiment, the carboxylic acids are aromatic carboxylic acids. A group of useful aromatic carboxylic acids are those of the formula

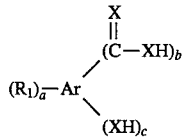

(XIII)

wherein $R_1$ is an aliphatic hydrocarbyl group preferably derived from the above-described polyalkenes, a is a number in the range of zero to about 4, usually 1 or 2, Ar is an aromatic group, each X is independently sulfur or oxygen, preferably oxygen, b is a number in the range of from 1 to about 4, usually 1 or 2, c is a number in the range of zero to about 4, usually 1 to 2, with the proviso that the sum of a, b and c does not exceed the number of valences of Ar. Examples of aromatic acids include substituted and non-substituted benzoic, phthalic, and salicylic acids.

The $R_1$ group is a hydrocarbyl group that is directly bonded to the aromatic group Ar. Examples of $R_1$ groups include substituents derived from polymerized olefins such as polyethylenes, polypropylenes, polyisobutylenes, ethylene-propylene copolymers, chlorinated olefin polymers and oxidized ethylene-propylene copolymers.

The aromatic group Ar may have the same structure as any of the aromatic groups Ar discussed below. Examples of the aromatic groups that are useful herein include the polyvalent aromatic groups derived from benzene, naphthalene, anthracene, etc., preferably benzene. Specific examples of Ar groups include phenylenes and naphthylene, e.g., methylphenylenes, ethoxyphenylenes, isopropylphenylenes, hydroxyphenylenes, dipropoxynaphthylenes, etc.

Within this group of aromatic acids, a useful class of carboxylic acids are those of the formula

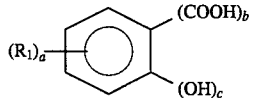

wherein $R_1$ is defined above, a is a number in the range of from zero to about 4, preferably 1 to about 3; b is a number in the range of 1 to about 4, preferably 1 to about 2, c is a number in the range of zero to about 4, preferably 1 to about 2, and more preferably 1; with the proviso that the sum of a, b and c does not exceed 6. Preferably, b and c are each one and the carboxylic acid is a salicylic acid.

The salicylic acids preferably are aliphatic hydrocarbon-substituted salicyclic acids. Overbased salts prepared from such salicyclic acids wherein the aliphatic hydrocarbon substituents are derived from the above-described polyalkenes, particularly polymerized lower 1-monoolefins such as polyethylene, polypropylene, polybutylene, ethylene/propylene copolymers and the like and having average carbon contents of about 50 to about 400 carbon atoms based on number average molecular weight are particularly useful.

The above aromatic carboxylic acids are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791.

The sulfonic acids are preferably mono-, di-, and tri-aliphatic hydrocarbon-substituted aromatic sulfonic acids. The hydrocarbon substituent may be derived from any of the above-described polyalkenes. Such sulfonic acids include mahogany sulfonic acids, bright stock sulfonic acids, petroleum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl betanaphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetraisobutylene sulfonic acids, tetraamylene sulfonic acids, chloro-substituted paraffin wax sulfonic acids, nitroso-substituted paraffin wax sulfonic acids, cetylcyclopentyl sulfonic acids, lauryl cyclohexyl sulfonic acids, mono- and polywax-substituted cyclohexyl sulfonic acids, dodecylbenzene sulfonic acids, didodecylbenzene sulfonic acids, dinonylbenzene sulfonic acids, cetylchlorobenzene sulfonic acids, dilauryl betanaphthalene sulfonic acids, the sulfonic acid derived by the treatment of at least one of the above-described polyalkenes (preferably polybutene) with chlorosulfonic acid, nitronaphthalene sulfonic acid, paraffin wax sulfonic acid, cetylcyclopentane, sulfonic acid, lauryl-cyclohexane sulfonic acids, polyethylenyl substituted sulfonic acids derived from polyethylene ($\overline{M}n$ equals about 300–1500, preferably about 700–1500, more preferably about 800–1200) sulfonic acids, etc., "dimer alkylate" sulfonic acids, and the like.

Alkyl-substituted benzene sulfonic acids wherein the alkyl group contains at least 8 carbon atoms, including dodecyl benzene "bottoms" sulfonic acids, are particularly useful. The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

A preferred group of sulfonic acids are mono-, di-, and tri-alkylated benzene and naphthalene (including hydrogenated forms thereof) sulfonic acids. Illustrative of the synthetically produced alkylated benzene and naphthaline sulfonic acids are those containing alkyl substituents having from about 8 to about 30 carbon atoms, preferably about 12 to about 30 carbon atoms, and advantageously about 24 carbon atoms. Such acids include di-isododecylbenzene sulfonic acid, wax-substituted phenol sulfonic acid, wax-substituted benzene sulfonic acids, polybutenyl-substituted sulfonic acid, polypropylene-substituted sulfonic acids derived from polypropylene having a number average molecular weights ($\overline{M}n$) of about 300–1500, more preferably about 800–1200, cetyl-chlorobenzene sulfonic acid, di-cetylnaphthalene sulfonic acid, di-lauryldiphenylether sulfonic acid, diisononylbenzene sulfonic acid, di-isooctadecylbenzene sulfonic acid, stearylnaphthalene sulfonic acid, and the like.

The production of sulfonic acids from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol 19, pp. 291 et seq. published by John Wiley & Sons, New York (1969).

The phosphorus-containing acids useful in making the salts of the present invention include any phosphorus acids such as phosphoric acid or esters; and thiophosphorus acids or esters, including mono and dithiophosphorus acids or esters.

In a preferred embodiment, the phosphorus-containing acid is the reaction product of the above polyalkene and phosphorus sulfide. Useful phosphorus sulfide-containing sources include phosphorus pentasulfide, phosphorus sesquisulfide, phosphorus heptasulfide and the like.

The reaction of the polyalkene and the phosphorus sulfide generally may occur by simply mixing the two at a temperature above 80° C., preferably between 100° C. and 300° C. Generally, the products have a phosphorus content from about 0.05% to about 10%, preferably from about 0.1% to about 5%. The relative proportions of the phosphorizing agent to the olefin polymer is generally from 0.1 part to 50 parts of the phosphorizing agent per 100 parts of the olefin polymer.

The phosphorus-containing acids useful in the present invention are described in U.S. Pat. No. 3,232,883 issued to Le Suer. This reference is herein incorporated by reference for its disclosure to the phosphorus-containing acids and methods for preparing the same.

The phenols useful in making the overbased salts of the invention can be represented by the formula $(R_1)_a$—Ar—$(OH)_b$, wherein $R_1$ is defined above; Ar is an aromatic group; a and b are independently numbers of at least one, the sum of a and b being in the range of two up to the number of displaceable hydrogens on the aromatic nucleus or nuclei of Ar. Preferably, a and b are independently numbers in the range of 1 to about 4, more preferably 1 to about 2. $R_1$ and a are preferably such that there is an average of at least about 8 aliphatic carbon atoms provided by the $R_1$ groups for each phenol compound.

While the term "phenol" is used herein, it is to be understood that this term is not intended to limit the aromatic group of the phenol to benzene. Accordingly, it is to be understood that the aromatic group as represented by "Ar", as well as elsewhere in other formulae in this specification and in the appended claims, can be mononuclear such as a phenyl, a pyridyl, or a thienyl, or polynuclear. The polynuclear groups can be of the fused type wherein an aromatic nucleus is fused at two points to another nucleus such as found in naphthyl, anthranyl, etc. The polynuclear group can also be of the linked type wherein at least two nuclei (either mononuclear or polynuclear) are linked through bridging linkages to each other. These bridging linkages can be chosen from the group consisting of alkylene linkages, ether linkages, keto linkages, sulfide linkages, polysulfide linkages of 2 to about 6 sulfur atoms, etc.

The number of aromatic nuclei, fused, linked or both, in Ar can play a role in determining the integer values of a and b. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

The promoters, that is, the materials which facilitate the incorporation of the excess metal into the overbased material, are also quite diverse and well known in the art. A particularly comprehensive discussion of suitable promoters is found in U.S. Pat. Nos. 2,777,874; 2,695,910; 2,616,904; 3,384,586; and 3,492,231. These patents are incorporated by reference for their disclosure of promoters. In one embodiment, promoters include the alcoholic and phenolic promoters. The alcoholic promoters include the alkanols of one to about 12 carbon atoms such as methanol, ethanol, amyl alcohol, octanol, isopropanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

Acidic materials, which are reacted with the mixture of acidic organic compound, promoter, metal compound and reactive medium, are also disclosed in the above cited patents, for example, U.S. Pat. No. 2,616,904. Included within the known group of useful acidic materials are liquid acids such as formic acid, acetic acid, nitric acid, boric acid, sulfuric acid, hydrochloric acid, hydrobromic acid, carbamic acid, substituted carbamic acids, etc. Acetic acid is a very useful acidic material although inorganic acidic compounds such as HCl, $SO_2$, $SO_3$, $CO_2$, $H_2S$, $N_2O_3$, etc., are ordinarily employed as the acidic materials. Preferred acidic materials are carbon dioxide and acetic acid, more preferably carbon dioxide.

The alkali metals present in the overbased alkali metal salts include principally lithium, sodium and potassium, with sodium and potassium being preferred and with sodium most preferred. The overbased metal salts are prepared using a basic alkali metal compound. Illustrative of basic alkali metal compounds are hydroxides, oxides, alkoxides (typically those in which the alkoxy group contains up to 10 and preferably up to 7 carbon atoms), hydrides and amides of alkali metals. Thus, useful basic alkali metal compounds include sodium hydroxide, potassium hydroxide, lithium hydroxide, sodium propoxide, lithium methoxide, potassium ethoxide, sodium butoxide, lithium hydride, sodium hydride, potassium hydride, lithium amide, sodium amide and potassium amide. Especially preferred are sodium hydroxide and the sodium lower alkoxides (i.e., those containing up to 7 carbon atoms).

The methods for preparing the overbased materials as well as an extremely diverse group of overbased materials are well known in the prior art and are disclosed, for example, in the following U.S. Pat. Nos. 2,616,904; 2,616,905; 2,616,906; 3,242,080; 3,250,710; 3,256,186; 3,274,135; 3,492,231; and 4,230,586. These patents disclose processes, materials which can be overbased, suitable metal bases, promoters, and acidic materials and these disclosures are incorporated herein by reference.

Other descriptions of basic sulfonate salts which can be incorporated into the lubricating oil compositions of this invention and techniques for making them can be found in the following U.S. Pat. Nos. 2,174,110; 2,202,781; 2,239,974; 2,319,121; 2,337,552; 3,488,284; 3,595,790; and 3,798,012. These are hereby incorporated by reference for their disclosures in this regard.

The temperature at which the acidic material is contacted with the remainder of the reaction mass depends to a large measure upon the promoting agent used. With a phenolic promoter, the temperature usually ranges from about 80° C. to about 300° C., and preferably from about 100° C. to about 200° C. When an alcohol or mercaptan is used as the promoting agent, the temperature usually will not exceed the reflux temperature of the reaction mixture.

In another embodiment, the alkali metal overbased salts are borated alkali metal overbased salts. Borated overbased metal salts are prepared by reacting a boron compound with a detergent or by using boric acid to overbase the organic acid. Boron compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids. The boron esters are preferably lower alkyl (1–7 carbon atoms) esters of boric acid. Preferably, the boron compounds are boric acid. Generally, the overbased metal salt is reacted with a boron compound at about 50° C. to about 250° C., preferably 100° C. to about 200° C. The reaction may be accomplished in the presence of a solvent such as mineral oil, naphtha, kerosene, toluene or xylene. The overbased metal salt is reacted with a boron compound in amounts to provide at least about 0.5 to about 5 percent by weight boron to the composition, preferably about 1 to about 4 percent by weight, more preferably about 3.

Borated overbased compositions, lubricating compositions containing the same and methods of preparing borated overbased compositions are found in U.S. Pat. No. 4,744,922 issued to Fischer et al; U.S. Pat. No. 4,792,410 issued to Schwind et al and PCT Publication WO88/03144. The disclosures relating to the above are hereby incorporated by reference.

The overbased alkali metal salts of this invention and their preparations are illustrated in the following examples.

EXAMPLE A-1

A solution of 780 parts (1 equivalent) of an alkylated benzenesulfonic acid (57% by weight 100 neutral mineral oil and unreacted alkylated benzene) and 119 parts (0.2 equivalents) of the polybutenyl succinic anhydride in 442 parts of mineral oil is mixed with 800 parts (20 equivalents) of sodium hydroxide and 704 parts (22 equivalents) of methanol. The mixture is blown with carbon dioxide at 7 cfh (cubic feet per hour) for 11 minutes as the temperature slowly increases to 97° C. The rate of carbon dioxide flow is reduced to 6 cfh and the temperature decreases slowly to 88° C. over about 40 minutes. The rate of carbon dioxide flow is reduced to 5 cfh. for about 35 minutes and the temperature slowly decreases to 73° C. The volatile materials are stripped by blowing nitrogen through the carbonated mixture at 2 cfh. for 105 minutes as the temperature is slowly increased to 160° C. After stripping is completed, the mixture is held at 160° C. for an additional 45 minutes and then filtered to yield an oil solution of the desired basic sodium sulfonate having a metal ratio of about 19.75.

EXAMPLE A-2

Following the procedure of Example A-1, 836 parts (1 equivalent) of a 48% 100 neutral mineral oil solution of a sodium petroleum sulfonate and 63 parts (0.11 equivalent) of the polybutenyl succinic anhydride is heated to 60° C. and treated with 280 parts (7 equivalents) of sodium hydroxide and 320 parts (10 equivalents) of methanol. The reaction mixture is blown with carbon dioxide at 4 cfh. for about 45 minutes. During this time, the temperature increases to 85° C. and then slowly decreases to 74° C. The volatile material is stripped by blowing with nitrogen at 2 cfh. while the temperature is gradually increased to 160° C. After stripping is completed, the mixture is heated an additional 30 minutes at 160° C. and then is filtered to yield the sodium salt in solution. The product has a metal ratio of 8.0.

EXAMPLE A-3

A sodium carbonate overbased (20:1 equivalent) sodium sulfonate (1000 parts, 7.84 equivalents) is mixed with 130 parts of 100 neutral mineral oil in a reaction vessel. The mixture of the sodium carbonate overbased sodium sulfonate and the mineral oil is heated to 75° C. Boric acid (486 parts, 7.84 moles) is then added slowly without substantially changing the temperature of the mixture.

The reaction mixture is then slowly heated to 100° C. over a period of about 1 hour while removing substantially all of the distillate. About one-half of the carbon dioxide is removed, without substantial foaming. The product is then further heated to 150° C. for about 3 hours while removing all of the distillate. It is observed that at the latter temperature, substantially all of the water is removed and very little additional carbon dioxide is evolved from the product. The product is then held for another hour at 150° C. until the water content of the product is less than about 0.3%.

The product is recovered by allowing it to cool to 100° C.–120° C. followed by filtration. The filtrate has 6.12% boron, 14.4% Na, and 35% 100 neutral mineral oil.

EXAMPLE A-4

A reaction vessel is charged with 1122 parts (2 equivalents) of a polybutenyl substituted succinic anhydride, 105 parts (0.4 equivalents of tetrapropenyl phenol), 1122 parts of xylene and 1000 grams of 100 neutral mineral oil. The reaction mixture is stirred and heated to 80° C. under nitrogen, where 580 parts of a 50% aqueous solution of sodium hydroxide is added to the vessel over 10 minutes. The reaction mixture is heated from 80° C. to 120° C. over 1.3 hours. Water is removed by azeotropic reflux and the temperature rises to 150° C. over 6 hours while 300 parts of water is collected. (1) The reaction is cooled to 80° C. where 540 parts of a 50% aqueous solution of sodium hydroxide is added to the vessel. (2) The reaction mixture is heated to 140° C. over 1.7 hours and water is removed at reflux conditions. (3) The reaction mixture is carbonated at 1 standard cubic feet per hour (scfh) while removing water as a xylene-water azeotrope for 5 hours. Steps (1)–(3) above are repeated using 560 parts of an aqueous sodium hydroxide solution. Steps (1)–(3) are repeated using 640 parts of an aqueous sodium hydroxide solution. Steps (1)–(3) are then repeated with another 640 parts of a 50% aqueous sodium hydroxide solution. The reaction mixture is cooled and 1000 parts of 100 neutral mineral oil are added to the reaction mixture. The reaction mixture is vacuum stripped to 115° C., 30 millimeters of mercury. The reaction mixture is filtered through diatomaceous earth. The filtrate has a total base number of 361 (theoretical 398), 43.4% sulfated ash (theoretical 50.3) and a specific gravity of 1.11.

EXAMPLE A-5

A reaction vessel is charged with 1561 parts (1.11 equivalents) of an oil solution of a bright stock sulfonic acid derived from Mobil 150 bright stock (molecular weight 600 and 72% bright stock diluent), 107 parts (0.27 equivalent) of sulfur coupled tetrapropylene substituted phenol (27% 100 neutral mineral oil), 178 parts (0.31 equivalent) of a polybutenyl substituted succinic anhydride derived from a polybutene ($\overline{M}n$ equals 960), 118 parts 100 neutral mineral oil and 1000 parts toluene. The mixture is heated to 100° C. whereupon 591 parts (7.4 equivalents) of a 50% aqueous solution of sodium hydroxide is added to the reaction mixture. The reaction mixture is blown with carbon dioxide for 1.75 hours at 1 scfh while 275 parts of water are removed. The reaction is cooled at 90° C. and the 275 parts of water are readied to the reaction mixture. The reaction is heated to 100° C. and the temperature is maintained for two hours, whereupon 31 parts (0.05 equivalent) of the above polybutenyl succinic anhydride and 36 parts (0.09 equivalent) of the sulfur coupled tetrapropenyl phenol are added in 100 parts of toluene. The reaction mixture is blown with carbon dioxide for four hours at 117° C. while 350 parts of water are removed. The reaction is cooled to 80° C. where 434 parts (5.4 equivalents) of the aqueous sodium hydroxide are added to the reaction mixture. The mixture is blown with carbon dioxide for 3.5 hours while 550 parts of water are removed. The reaction is cooled to 90° C. where 600 parts (7.5 equivalents) of the aqueous sodium hydroxide are added to the reaction mixture. The mixture is blown with carbon dioxide for eight hours at a temperature of 105°–112° C. while 870 parts of water are removed. The reaction mixture is cooled to 40° C. where 601 parts (7.5 equivalents) of the aqueous sodium hydroxide are added to the reaction mixture. The reaction mixture is heated to 110°–112° C. and blown with carbon dioxide for seven hours while 1150 parts of water are removed. The reaction is cooled to 60° C. where 164 parts (2.1 equivalents) of aqueous sodium hydroxide are added to the reaction mixture. The reaction mixture is heated to 110° C.–120° C. and blown with carbon dioxide for 7 hours, while a total of 1410 parts of water are removed.

The mixture is blown with nitrogen at 2 scfh for six hours at 140° C. The product is filtered through diatomacous earth and the filtrate is the desired product. The filtrate has a total base number of 446.

B) Dispersants

The lubricating compositions contain at least one dispersant. The dispersants are selected from the group consisting of: (a) nitrogen-containing carboxylic dispersants, (b) amine dispersants, (c) ester dispersants, (d) Mannich dispersants, (e) dispersant viscosity improvers and (f) mixtures thereof. In one embodiment, the dispersants may be post-treated with such reagents as urea, thiourea carbon disulfide, aldehydes, ketones, carboxylic acids, hydrocarbon-substituted succinic anhydrides, nitriles, epoxides, boron compounds, phosphorus compounds, etc.

The nitrogen-containing carboxylic dispersants include reaction products of hydrocarbyl-substituted carboxylic acylating agents such as substituted carboxylic acids or derivatives thereof with an amine.

The hydrocarbyl-substituted carboxylic acylating agent may be derived from a monocarboxylic acid or a polycarboxylic acid. Polycarboxylic acids generally are preferred. The acylating agents may be a carboxylic acid or derivatives of the carboxylic acid such as the halides, esters, anhydrides, etc., preferably acid, esters or anhydrides, more preferably anhydrides. Preferably the carboxylic acylating agent is a succinic acylating agent. The hydrocarbyl-substituted carboxylic acylating agent includes agents which have a hydrocarbyl group derived from the above-described polyalkene.

In one embodiment, the hydrocarbyl groups are derived from polyalkenes having an $\overline{M}n$ value of at least about 1300 up to about 5000, and the $\overline{M}w/\overline{M}n$ value is from about 1.5 to about 4, preferably from about 1.8 to about 3.6, more preferably about 2.5 to about 3.2. The preparation and use of substituted succinic acylating agents wherein the substituent is derived from such polyalkenes are described in U.S. Pat. No. 4,234,435, the disclosure of which is hereby incorporated by reference.

The hydrocarbyl-substituted carboxylic acylating agents are prepared by a reaction of one or more polyalkenes with one or more unsaturated carboxylic reagent. The unsaturated carboxylic reagent generally contains an alpha-beta olefinic unsaturation. The carboxylic reagents may be carboxylic acids per se and functional derivatives thereof, such as anhydrides, esters, amides, imides, salts, acyl halides, and nitriles. These carboxylic acid reagents may be either monobasic or polybasic in nature. When they are polybasic they are preferably dicarboxylic acids, although tri- and tetracarboxylic acids can be used. Specific examples of useful monobasic unsaturated carboxylic acids are acrylic acid, methacrylic acid, cinnamic acid, crotonic acid, 2-phenylpropenoic acid, etc. Exemplary polybasic acids include maleic acid, fumaric acid, mesaconic acid, itaconic acid and citraconic acid. Generally, the unsaturated carboxylic acid or derivative is maleic anhydride or maleic or fumaric acid or ester, preferably, maleic acid or anhydride, more preferably maleic anhydride.

The polyalkene may be reacted with the carboxylic reagent such that there is at least one mole of reagent for each mole of polyalkene that reacts. Preferably, an excess of reagent is used. This excess is generally between about 5% to about 25%.

In another embodiment, the acylating agents are prepared by reacting the above described polyalkene with an excess of maleic anhydride to provide substituted succinic acylating agents wherein the number of succinic groups for each equivalent weight of substituent group is at least 1.3. The maximum number will not exceed 4.5. A suitable range is from about 1.4 to 3.5 and more specifically from about 1.4 to about 2.5 succinic groups per equivalent weight of substituent groups. In this embodiment, the polyalkene preferably has an $\overline{M}n$ from about 1300 to about 5000 and a $\overline{M}w/\overline{M}n$ of at least 1.5, as described above, the value of $\overline{M}n$ is preferably between about 1300 and 5000. A more preferred range for $\overline{M}n$ is from about 1500 to about 2800, and a most preferred range of $\overline{M}n$ values is from about 1500 to about 2400.

For purposes of this invention, the number of equivalent weights of substituent groups is deemed to be the number obtained by dividing the $\overline{M}n$ value of the polyalkene from which the substituent is derived into the total weight of the substituent groups present in the substituted succinic acylating agents. Thus, if a substituted succinic acylating agent is characterized by a total weight of substituent group of 40,000, and the $\overline{M}n$ value for the polyalkene from which the substituent groups are derived is 2000, then that substituted succinic acylating agent is characterized by a total of 20 (40,000/2000=20) equivalent weights of substituent groups. Therefore, that particular succinic acylating agent or acylating agent mixture must also be characterized by the presence within its structure of at least 26 succinic groups to meet one of the requirements of the succinic acylating agents used in this invention.

The ratio of succinic groups to the equivalent weight of substituent group present in the acylating agent can be determined from the saponification number of the reacted mixture corrected to account for unreacted polyalkene present in the reaction mixture at the end of the reaction (generally referred to as filtrate or residue in the following examples). Saponification number is determined using the ASTM D-94 procedure. The formula for calculating the ratio from the saponification number is as follows:

$$\text{Ratio} = \frac{(\overline{M}n)\ (\text{Sap No., corrected})}{112{,}200 - 98\ (\text{Sap No., corrected})}$$

The corrected saponification number is obtained by dividing the saponification number by the percent of the polyalkene that has reacted. For example, if 10% of the polyalkene did not react and the saponification number of the filtrate or residue is 95, the corrected saponification number is 95 divided by 0.90 or 105.5.

The conditions, i.e., temperature, agitation, solvents, and the like, for reacting an acid reactant with a polyalkene, are known to those in the art. Examples of patents describing various procedures for preparing useful acylating agents include U.S. Pat. Nos. 3,215,707 (Rense); 3,219,666 (Norman et al); 3,231,587 (Rense); 3,912,764 (Palmer); 4,110,349 (Cohen); and 4,234,435 (Meinhardt et al); and U.K. 1,440,219. The disclosures of these patents are hereby incorporated by reference.

The following examples illustrate the carboxylic acylating agents and methods for preparing them. The desired acylating agents are sometimes referred to in the examples as "residue" without specific determination or mention of other materials present or the amounts thereof.

EXAMPLE I

A mixture of 510 parts (0.28 mole) of polybutene ( $\overline{M}n$=1845; $\overline{M}w$=5325) and 59 parts (0.59 mole) of maleic anhydride is heated to 110° C. This mixture is heated to 190° C. in 7 hours during which 43 parts (0.6 mole) of gaseous chlorine is added beneath the surface. At 190°–192° C. an additional 11 parts (0.16 mole) of chlorine is added over 3.5 hours. The reaction mixture is stripped by heating at 190°–193° C. with nitrogen blowing for 10 hours. The residue is the desired polybutene-substituted succinic acylating agent having a saponification equivalent number of 87 as determined by ASTM procedure D-94.

EXAMPLE II

A mixture of 1000 parts (0.495 mole) of polybutene ( $\overline{M}n$=2020; $\overline{M}w$=6049) and 115 parts (1.17 moles) of maleic anhydride is heated to 110° C. This mixture is heated to 184° C. in 6 hours during which 85 parts (1.2 moles) of gaseous chlorine is added beneath the surface. At 184°–189° C. an additional 59 parts (0.83 mole) of chlorine is added over 4 hours. The reaction mixture is stripped by heating at 186°–190° C. with nitrogen blowing for 26 hours. The residue is the desired polybutene-substituted succinic acylating agent having a saponification equivalent number of 87 as determined by ASTM procedure D-94.

The above-described carboxylic acylating agents are reacted with amines to form the nitrogen-containing carboxylic dispersants of the present invention. The amine may be a monoamine or polyamine, typically a polyamine, preferably ethylene amines, amine bottoms or amine condensates. The amines can be aliphatic, cycloaliphatic, aromatic, or heterocyclic, including aliphatic-substituted cycloaliphatic, aliphatic-substituted aromatic, aliphatic-substituted heterocyclic, cycloaliphatic-substituted aliphatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted alicyclic, and heterocyclic-substituted aromatic amines and may be saturated or unsaturated.

The monoamines generally contain from 1 to about 24 carbon atoms, preferably 1 to about 12, and more preferably 1 to about 6. Examples of monoamines useful in the present invention include methylamine, ethylamine, propylamine, butylamine, cyclopentylamine, cyclohexylamine, octylamine, dodecylamine, allylamine, cocoamine, stearylamine, and laurylamine. Examples of secondary amines include dimethylamine, diethylamine, dipropylamine, dibutylamine, dicyclopentylamine, dicyclohexylamine, methylbutylamine, ethylhexylamine, etc. Tertiary amines include trimethylamine, tributylamine, methyldiethylamine, ethyldibutylamine, etc.

In another embodiment, the amine may be a hydroxyamine. Typically, the hydroxyamines are primary, secondary or tertiary alkanol amines or mixtures thereof. Such amines can be represented by the formulae:

$$H_2N-R'-OH,$$

-continued

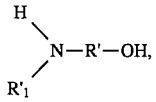

and

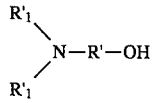

wherein each $R'_1$ is independently a hydrocarbyl group of one to about eight carbon atoms or hydroxyhydrocarbyl group of two to about eight carbon atoms, preferably one to about four, and R' is a divalent hydrocarbyl group of about two to about 18 carbon atoms, preferably two to about four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. Where two $R'_1$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R'_1$ is independently a methyl, ethyl, propyl, butyl, pentyl or hexyl group.

Examples of these alkanolamines include mono-, di-, and triethanol amine, diethylethanolamine, ethylethanolamine, butyldiethanolamine, etc.

The hydroxyamines can also be an ether N-(hydroxyhydrocarbyl)amine. These are hydroxypoly(hydrocarbyloxy) analogs of the above-described hydroxy amines (these analogs also include hydroxyl-substituted oxyalkylene analogs). Such N-(hydroxyhydrocarbyl) amines can be conveniently prepared by reaction of epoxides with aforedescribed amines and can be represented by the formulae:

$$H_2N-(R'O)_x-H,$$

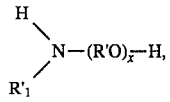

and

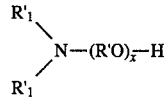

wherein x is a number from about 2 to about 15 and $R_1$ and R' are as described above. $R'_1$ may also be a hydroxypoly(hydrocarbyloxy) group.

Suitable amines also include polyoxyalkylene polyamines, e.g., polyoxyalkylene diamines and polyoxyalkylene triamines, having average molecular weights ranging from about 200 to 4000 and preferably from about 400 to 2000. Illustrative examples of these polyoxyalkylene polyamines may be characterized by the formulae: $NH_2$-Alkylene(O-Alkylene)$_m$$NH_2$, wherein m has a value of about 3 to 70 and preferably about 10 to 35; and R(Alkylene(O-Alkylene)$_n$$NH_2$)$_{3-6}$, wherein n is such that the total value is from about 1 to 40 with the proviso that the sum of all of the n's is from about 3 to about 70 and generally from about 6 to about 35 and R is a polyvalent saturated hydrocarbon radical of up to 10 carbon atoms having a valence of 3 to 6. The alkylene groups may be straight or branched chains and contain from 1 to 7 carbon atoms and usually from 1 to 4 carbon atoms. The various alkylene groups present may be the same or different.

The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available an may be obtained, for example, from the Jefferson Chemical Company, Inc. under the trade name "Jeffamines D-230, D-400, D-1000, D-2000, T-403, etc.".

U.S. Pat. Nos. 3,804,763 and 3,948,800 are expressly incorporated herein by reference for their disclosure of such polyoxyalkylene polyamines and process for acylating them with carboxylic acid acylating agents which processes can be applied to their reaction with the acylating reagents used in this invention.

The nitrogen-containing carboxylic dispersant may be derived from a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula

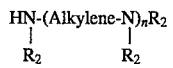

wherein n has an average value from 1 to about 10, preferably about 2 to about 7, more preferably about 2 to about 5, and the "Alkylene" group has from 1 to about 10 carbon atoms, preferably about 2 to about 6, more preferably about 2 to about 4. $R_2$ is independently preferably hydrogen; or an aliphatic or hydroxy-substituted aliphatic group of up to about 30 carbon atoms. Preferably $R_2$ is defined the same as $R'_1$.

Such alkylene polyamines include methylene polyamines, ethylene polyamines, butylene polyamines, propylene polyamines, pentylene polyamines, etc. The higher homologs and related heterocyclic amines such as piperazines and N-amino alkyl-substituted piperazines are also included. Specific examples of such polyamines are ethylene diamine, triethylene tetramine, tris-(2aminoethyl)amine, propylene diamine, trimethylene diamine, tripropylene tetramine, tetraethylene pentamine, hexaethylene heptamine, pentaethylenehexamine, etc.

Higher homologs obtained by condensing two or more of the above-noted alkylene amines are similarly useful as are mixtures of two or more of the aforedescribed polyamines.

Ethylene polyamines, such as those mentioned above, are useful. Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. Ethylene polyamine mixtures are useful.

Other useful types of polyamine mixtures are those resulting from stripping of the above-described polyamine mixtures to leave as residue what is often termed "polyamine bottoms". In general, alkylene polyamine bottoms can be characterized as having less than two, usually less than 1% (by weight) material boiling below about 200° C. A typical sample of such ethylene polyamine bottoms obtained from the Dow Chemical Company of Freeport, Texas designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably DETA), 0.72% TETA, 21.74% tetraethylene pentaamine and 76.61% pentaethylene hexamine and higher (by weight). These alkylene polyamine bottoms include cyclic condensation products such as piperazine and higher analogs of diethylenetriamine, triethylenetetramine and the like.

These alkylene polyamine bottoms can be reacted solely with the acylating agent or they can be used with other amines, polyamines, or mixtures thereof.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. (See carboxylic ester dispersants.) Preferably the hydroxy compounds are polyhydric amines. Polyhydric amines include any of the above-described monoamines reacted with an alkylene oxide (e.g., ethylene oxide, propylene oxide, butylene oxide, etc.) having two to about 20 carbon atoms, preferably two to about four. Examples of polyhydric amines include tri-(hydroxypropyl)amine, tris-(hydroxymethyl)amino methane, 2 -amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris(hydroxymethyl)aminomethane (THAM).

Polyamine reactants, which react with the polyhydric alcohol or amine to form the condensation products or condensed amines, are described above. Preferred polyamine reactants include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually about 60° C. to about 265° C., (preferably about 220° C. to about 250° C.) in the presence of an acid catalyst.

The amine condensates and methods of making the same are described in PCT publication W086/05501 which is incorporated by reference for its disclosure to the condensates and methods of making. The preparation of such polyamine condensates may occur as follows: A 4-necked 3-liter round-bottomed flask equipped with glass stirrer, thermowell, subsurface $N_2$ inlet, Dean-Stark trap, and Friedrich condenser is charged with: 1299 grams of HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and 727 grams of 40% aqueous tris(hydroxymethyl)aminomethane (THAM). This mixture is heated to 60° C. and 23 grams of 85% $H_3PO_4$ is added. The mixture is then heated to 120° C. over 0.6 hour. With $N_2$ sweeping, the mixture is then heated to 150° C. over 1.25 hour, then to 235° C. over 1 hour more, then held at 230°–235° C. for 5 hours, then heated to 240° C. over 0.75 hour, and then held at 240°–245° C. for 5 hours. The product is cooled to 150° C. and filtered with a diatomaceous earth filter aid. Yield: 84% (1221 grams).

In another embodiment, the polyamines are hydroxy-containing polyamines. Hydroxy-containing polyamine analogs of hydroxy monoamines, particularly alkoxylated alkylenepolyamines (e.g., N,N(diethanol)ethylene diamine) can also be used. Such polyamines can be made by reacting the above-described alkylene amines with one or more of the above-described alkylene oxides. Similar alkylene oxideal-kanol amine reaction products can also be used such as the products made by reacting the aforedescribed primary, secondary or tertiary alkanol amines with ethylene, propylene or higher epoxides in a 1.1 to 1.2 molar ratio. Reactant ratios and temperatures for carrying out such reactions are known to those skilled in the art.

Specific examples of alkoxylated alkylenepolyamines include N-(2-hydroxyethyl) ethylenediamine, N,N-bis(2-hydroxyethyl)-ethylene-diamine, 1-(2-hydroxyethyl)piperazine, mono(hydroxypropyl)-substituted tetraethylenepentamine, N-(3-hydroxybutyl)-tetramethylene diamine, etc. Higher homologs obtained by condensation of the above-illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

In another embodiment, the amine is a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkylsubstituted piperidines, piperazine, aminoalkyl-substituted piperazines, morpholine, aminoalkylsubstituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

Hydrazine and substituted-hydrazine can also be used to form nitrogen-containing carboxylic dispersants. At least one of the nitrogens in the hydrazine must contain a hydrogen directly bonded thereto. Preferably there are at least two hydrogens bonded directly to hydrazine nitrogen and, more preferably, both hydrogens are on the same nitrogen. The substituents which may be present on the hydrazine include alkyl, alkenyl, aryl, aralkyl, alkaryl, and the like. Usually, the substituents are alkyl, especially lower alkyl, phenyl, and substituted phenyl such as lower alkoxy substituted phenyl or lower alkyl substituted phenyl. Specific examples of substituted hydrazines are methylhydrazine, N,N-dimethylhydrazine, N,N'-dimethylhydrazine, phenylhydrazine, N-phenyl-N'-ethylhydrazine, N-(para-tolyl)-N'-(n-butyl)-hydrazine, N-(para-nitrophenyl)hydrazine, N-(para-nitrophenyl)-N-methyl-hydrazine, N,N'-di(para-chlorophenol)-hydrazine, N-phenyl-N'-cyclohexylhydrazine, and the like.

Nitrogen-containing carboxylic dispersants and methods for preparing the same are described in U.S. Pat. Nos. 4,234,435; 4,952,328; 4,938,881; 4,957,649; and 4,904,401. The disclosures of nitrogen-containing carboxylic dispersants and other dispersants contained in those patents is hereby incorporated by reference.

The following examples illustrate the nitrogen-containing carboxylic dispersants and methods for preparing them.

EXAMPLE B-1

A mixture is prepared by the addition of 8.16 parts (0.20 equivalent) of a commercial mixture of ethylene polyamines having from about 3 to about 10 nitrogen atoms per molecule to 113 parts of mineral oil and 161 parts (0.24 equivalent) of the substituted succinic acylating agent prepared in Example I at 138° C. The reaction mixture is heated to 150° C. in 2 hours and stripped by blowing with nitrogen. The reaction mixture is filtered to yield the filtrate as an oil solution of the desired product.

EXAMPLE B-2

A mixture is prepared by the addition of 18.2 parts (0.433 equivalent) of a commercial mixture of ethylene polyamines having from about 3 to 10 nitrogen atoms per molecule to 392 parts of mineral oil and 348 parts (0.52 equivalent) of the substituted succinic acylating agent prepared in Example II at 140° C. The reaction mixture is heated to 150° C. in 1.8 hours and stripped by blowing with nitrogen. The reaction mixture is filtered to yield the filtrate as an oil solution (55% oil) of the desired product.

Examples B-3 through B-8 are prepared by following the general procedure set forth in Example B-1.

| Example Number | Amine Reactant(s) | Equivalent Ratio of Acylating Agent (Ex. I) To Reactants | Percent Diluent |
|---|---|---|---|
| B-3 | Pentaethylene hexamine[a] | 4:3 | 40% |
| B-4 | Tris(2-aminoethyl) amine | 5:4 | 50% |
| B-5 | Imino-bis-propyl-amine | 8:7 | 40% |
| B-6 | Hexamethylene diamine | 4:3 | 40% |
| B-7 | 1-(2-Aminoethyl)-2-methyl-2-imidazoline | 5:4 | 40% |
| B-8 | N-Aminopropyl-pyrrolidone | 8:7 | 40% |

[a]A commercial mixture of ethylene polyamines corresponding in empirical formula to pentaethylene hexamine.

EXAMPLE B-9

A mixture of 3660 parts (6 equivalents) of a substituted succinic acylating agent prepared as in Example I in 4664 parts of diluent oil is prepared and heated at about 110° C. whereupon nitrogen is blown through the mixture. To this mixture there are then added 210 parts (5.25 equivalents) of an alkylene polyamine mixture, comprising 80% of ethylene polyamine bottoms from Union Carbide and 20% of a commercial mixture of ethylene polyamines corresponding in empirical formula to diethylene triamine, over a period of one hour and the mixture is maintained at 110° C. for an additional 0.5 hour. The polyamine mixture is characterized as having an equivalent weight of about 43.3. After heating for 6 hours at 155° C. while removing water, a filtrate is added and the reaction mixture is filtered at about 150° C. The filtrate is the oil solution of the desired product.

The dispersant may also be an amine dispersant. Amine dispersants are hydrocarbyl-substituted amines. These hydrocarbyl-substituted amines are well known to those skilled in the art. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same.

Typically, amine dispersants are prepared by reacting olefins and olefin polymers (polyalkenes) with amines (mono- or polyamines). The polyalkene may be any of the polyalkenes described above. The amines may be any of the amines described above. Examples of amine dispersants include poly(propylene)amine; N,N-dimethyl-N-poly(ethylene/propylene)amine, (50:50 mole ratio of monomers); polybutene amine; N,N-di(hydroxyethyl)-N-polybutene amine; N-(2-hydroxypropyl)-N-polybuteneamine;N-polybutene-aniline; N-polybutenemorpholine; N-poly(butene-)ethylenediamine; N-poly(propylene)trimethylenediamine; N-poly(butene)diethylenetriamine; N',N'-poly(butene)tetraethylenepentamine;N,N-dimethyl-N'-poly(propylene)-1,3-propylenediamine and the like.

In another embodiment, the dispersant may also be an ester dispersant. The ester dispersant is prepared by reacting at least one of the above hydrocarbyl-substituted carboxylic acylating agents with at least one organic hydroxy compound and optionally an amine. In another embodiment, the ester dispersant is prepared by reacting the acylating agent with at least one of the above-described hydroxy amine.

The organic hydroxy compound includes compounds of the general formula $R''(OH)_m$ wherein R" is a monovalent or polyvalent organic group joined to the —OH groups through a carbon bond, and m is an integer of from 1 to about 10 wherein the hydrocarbyl group contains at least about 8 aliphatic carbon atoms. The hydroxy compounds may be aliphatic compounds such as monohydric and polyhydric alcohols, or aromatic compounds such as phenols and naphthols. The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols from which the esters may be derived preferably contain up to about 40 aliphatic carbon atoms, preferably from 2 to about 30, more preferably 2 to about 10. They may be monohydric alcohols such as methanol, ethanol, isooctanol, dodecanol, cyclohexanol, etc. In one embodiment, the hydroxy compounds are polyhydric alcohols, such as alkylene polyols. Preferably, the polyhydric alcohols contain from 2 to about 40 carbon atoms, more preferably 2 to about 20; and preferably from 2 to about 10 hydroxyl groups, more preferably 2 to about 6. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol; preferably, diethylene glycol, triethylene glycol, glycerol, sorbitol, pentaerythritol and dipentaerythritol.

The polyhydric alcohols may be esterified with monocarboxylic acids having from 2 to about 30 carbon atoms, preferably about 8 to about 18, provided that at least one hydroxyl group remains unesterified. Examples of monocarboxylic acids include acetic, propionic, butyric and fatty carboxylic acids. The fatty monocarboxylic acids have from about 8 to about 30 carbon atoms and include octanoic, oleic, stearic, linoleic, dodecanoic and tall oil acids. Specific examples of these esterified polyhydric alcohols include sorbitol oleate, including mono- and dioleate, sorbitol stearate, including mono- and distearate, glycerol oleate, including glycerol mono-, di- and trioleate and erythritol octanoate.

The carboxylic ester dispersants may be prepared by any of several known methods. The method which is preferred because of convenience and the superior properties of the esters it produces, involves the reaction of a the carboxylic acylating agents described above with one or more alcohols or phenols in ratios of from about 0.5 equivalent to about 4 equivalents of hydroxy compound per equivalent of acylating agent. The esterification is usually carried out at a temperature above about 100° C., preferably between 150° C. and 300° C. The water formed as a by-product is removed by distillation as the esterification proceeds. The preparation of useful carboxylic ester dispersant is described in U.S. Pat. Nos. 3,522,179 and 4,234,435.

The carboxylic ester dispersants may be further reacted with at least one of the above described amines and preferably at least one of the above described polyamines. The amine is added in an amount sufficient to neutralize any nonesterified carboxyl groups. In one preferred embodiment, the nitrogen-containing carboxylic ester dispersants are prepared by reacting about 1.0 to 2.0 equivalents, preferably about 1.0 to 1.8 equivalents of hydroxy compounds, and up to about 0.3 equivalent, preferably about 0.02 to about 0.25 equivalent of polyamine per equivalent of acylating agent.

In another embodiment, the carboxylic acid acylating agent may be reacted simultaneously with both the alcohol and the amine. There is generally at least about 0.01 equivalent of the alcohol and at least 0.01 equivalent of the amine although the total amount of equivalents of the combination should be at least about 0.5 equivalent per equivalent of acylating agent. These nitrogen-containing carboxylic ester dispersant compositions are known in the art, and the preparation of a number of these derivatives is described in, for example, U.S. Pat. Nos. 3,957,854 and 4,234,435 which have been incorporated by reference previously.

The carboxylic ester dispersants and methods of making the same are known in the art and are disclosed in U.S. Pat. Nos. 3,219,666; 3,381,022; 3,522,179; and 4,234,435 which are hereby incorporated by reference for their disclosures of the preparation of carboxylic ester dispersants.

The following examples illustrate the ester dispersants and the processes for preparing such esters.

EXAMPLE B-10

A substantially hydrocarbon-substituted succinic anhydride is prepared by chlorinating a polybutene having a number average molecular weight of 1000 to a chlorine content of 4.5% and then heating the chlorinated polybutene with 1.2 molar proportions of maleic anhydride at a temperature of 150–°220° C. A mixture of 874 grams (2 equivalents) of the succinic anhydride and 104 grams (2 equivalents) of neopentyl glycol is maintained at 240°–250°

C./30 mm for 12 hours. The residue is a mixture of the esters resulting from the esterification of one and both hydroxy groups of the glycol.

EXAMPLE B-11

A mixture of 3225 parts (5.0 equivalents) of the polybutene-substituted succinic acylating agent prepared in Example II, 289 parts (8.5 equivalents) of pentaerythritol and 5204 parts of mineral oil is heated at 224°–235° C. for 5.5 hours. The reaction mixture is filtered at 130° C. to yield an oil solution of the desired product.

The carboxylic ester derivatives which are described above resulting from the reaction of an acylating agent with a hydroxy-containing compound such as an alcohol or a phenol may be further reacted with any of the above-described amines, and particularly polyamines in the manner described previously for the nitrogen-containing dispersants.

In another embodiment, the carboxylic acid acylating agent may be reacted simultaneously with both the alcohol and the amine. There is generally at least about 0.01 equivalent of the alcohol and at least 0.01 equivalent of the amine although the total amount of equivalents of the combination should be at least about 0.5 equivalent per equivalent of acylating agent. These carboxylic ester derivative compositions are known in the art, and the preparation of a number of these derivatives is described in, for example, U.S. Pat. Nos. 3,957,854 and 4,234,435 which are hereby incorporated by reference. The following specific examples illustrate the preparation of the esters wherein both alcohols and amines are reacted with the acylating agent.

EXAMPLE B-12

A mixture of 1000 parts of polybutene having a number average molecular weight of about 1000 and 108 parts (1.1 moles) of maleic anhydride is heated to about 190° C. and 100 parts (1.43 moles) of chlorine are added beneath the surface over a period of about 4 hours while maintaining the temperature at about 185°–190° C. The mixture then is blown with nitrogen at this temperature for several hours, and the residue is the desired polybutenyl-substituted succinic acylating agent.

A solution of 1000 parts of the above-prepared acylating agent in 857 parts of mineral oil is heated to about 150° C. with stirring, and 109 parts (3.2 equivalents) of pentaerythritol are added with stirring. The mixture is blown with nitrogen and heated to about 200° C. over a period of about 14 hours to form an oil solution of the desired carboxylic ester intermediate. To the intermediate, there are added 19.25 parts (0.46 equivalent) of a commercial mixture of ethylene polyamines having an average of about 3 to about 10 nitrogen atoms per molecule. The reaction mixture is stripped by heating at 205° C. with nitrogen blowing for 3 hours and filtered. The filtrate is an oil solution (45% 100 neutral mineral oil) of the desired amine-modified carboxylic ester which contains 0.35% nitrogen.

The dispersant may also be a Mannich dispersant. Mannich dispersants are generally formed by the reaction of at least one aldehyde, at least one of the above described amine and at least one alkyl substituted hydroxyaromatic compound. The reaction may occur from room temperature to 225° C., usually from 50° to about 200° C. (75° C.–150° C. most preferred), with the amounts of the reagents being such that the molar ratio of hydroxyaromatic compound to formaldehyde to amine is in the range from about (1:1:1) to about (1:3:3).

The first reagent is an alkyl substituted hydroxyaromatic compound. This term includes phenols (which are preferred), carbon-, oxygen-, sulfur- and nitrogen-bridged phenols and the like as well as phenols directly linked through covalent bonds (e.g. 4,4'-bis(hydroxy)biphenyl), hydroxy compounds derived from fused-ring hydrocarbon (e.g., naphthols and the like); and polyhydroxy compounds such as catechol, resorcinol and hydroquinone. Mixtures of one or more hydroxyaromatic compounds can be used as the first reagent.

The hydroxyaromatic compounds are those substituted with at least one, and preferably not more than two, aliphatic or alicyclic groups having at least about 6 (usually at least about 30, more preferably at least 50) carbon atoms and up to about 400 carbon atoms, preferably 300, more preferably 200. These groups may be derived from the above described polyalkenes. In one embodiment, the hydroxy aromatic compound is a phenol substituted with an aliphatic or alicyclic hydrocarbon-based group having an $\overline{M}n$ of about 420 to about 10,000.

The second reagent is a hydrocarbon-based aldehyde, preferably a lower aliphatic aldehyde. Suitable aldehydes include formaldehyde, benzaldehyde, acetaldehyde, the butyraldehydes, hydroxybutyraldehydes and heptanals, as well as aldehyde precursors which react as aldehydes under the conditions of the reaction such as paraformaldehyde, paraldehyde, formalin and methal. Formaldehyde and its precursors (e.g., paraformaldehyde, trioxane) are preferred. Mixtures of aldehydes may be used as the second reagent.

The third reagent is any amine described above. Preferably the amine is a polyamine as described above.

Mannnich dispersants are described in the following patents: U.S. Pat. Nos. 3,980,569; 3,877,899; and 4,454,059 (herein incorporated by reference for their disclosure to Mannich dispersants).

The dispersant may also be a dispersant-viscosity improver. The dispersant-viscosity improvers include polymer backbones which are functionalized by reacting with an amine source. A true or normal block copolymer or a random block copolymer, or combinations of both are utilized. They are hydrogenated before use in this invention to remove virtually all of their olefinic double bonds. Techniques for accomplishing this hydrogenation are well known to those of skill in the art. Briefly, hydrogenation is accomplished by contacting the copolymers with hydrogen at superatmospheric pressures in the presence of a metal catalyst such as colloidal nickel, palladium supported on charcoal, etc.

In general, it is preferred that these block copolymers, for reasons of oxidative stability, contain no more than about 5 percent and preferably no more than about 0.5 percent residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation, as determined by the aforementioned analytical techniques.

The block copolymers typically have number average molecular weights ($\overline{M}n$) in the range of about 10,000 to about 500,000 preferably about 30,000 to about 200,000. The weight average molecular weight ($\overline{M}w$) for these copolymers is generally in the range of about 50,000 to about 500,000, preferably about 30,000 to about 300,000.

The amine source may be an unsaturated amine compound or an unsaturated carboxylic reagent which is capable of reacting with an amine. The unsaturated carboxylic reagents and amines are described above.

Examples of saturated amine compounds include N-(3,6-dioxaheptyl)maleimide, N-(3-dimethylaminopropyl)maleimide, and N-(2-methoxyethoxyethyl)maleimide. Preferred amines are ammonia and primary amine containing compounds. Examples of such primary amine-containing compounds include N,N-dimethylhydrazine, methylamine, ethylamine, butylamine, 2-methoxyethylamine, N,N-dimethyl-1,3-propanediamine, N-ethyl-N-methyl-1,3-propanediamine, N-methyl-1,3-propanediamine, N-(3-aminopropyl)morpholine, 3-methoxypropylamine, 3-isobutyoxypropylamine and 4,7-di-oxyoctylamine, N-(3-aminopropyl)-N-1-methylpiperazine, N-(2-aminoethyl)piperazine, (2-aminoethyl)pyridines, aminopyridines, 2-aminoethylpyridines, 2-aminomethylfuran, 3-amino-2-oxotetrahydrofuran, N-(2-aminoethyl)pyrolidine, 2-aminomethylpyrrolidine, 1-methyl-2-aminomethylpyrrolidine, 1-amino-pyrrolidine, 1-(3-aminopropyl)-2-methylpiperidine, 4-aminomethylpiperidine, N-(2-aminoethyl)morpholine, 1-ethyl-3-aminopiperidine, 1-aminopiperidine, N-aminomorpholine, and the like. Of these compounds, N-(3-aminopropyl)morpholine and N-ethyl-N-methyl-1,3-propanediamine are preferred with N,N-dimethyl-1,3-propanediamine being highly preferred.

Another group of primary amine-containing compounds are the various amine terminated polyethers. The amine terminated polyethers are available commercially from Texaco Chemical Company under the general trade designation "Jeffamine®". Specific examples of these materials include Jeffamine® M-600; M-1000; M-2005; and M-2070 amines.

Examples of dispersant-viscosity improvers are given in the following references:

| | |
|---|---|
| EP 171,167 | 3,687,905 |
| 3,687,849 | 4,670,173 |
| 3,756,954 | 4,320,012 |
| 4,320,019 | |

(herein incorporated by reference for their disclosure to dispersant-viscosity improvers).

The above dispersants may be post-treated with one or more post-treating reagents selected from the group consisting of boron compounds (discussed above), carbon disulfide, hydrogen sulfide, sulfur, sulfur chlorides, alkenyl cyanides, carboxylic acid acylating agents, aldehydes, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyanates, epoxides, episulfides, formaldehyde or formaldehyde-producing compounds with phenols, and sulfur with phenols.

The following U.S. Patents are expressly incorporated herein by reference for their disclosure of post-treating processes and post-treating reagents applicable to the carboxylic derivative compositions of this invention: U.S. Pat. Nos. 3,087,936; 3,254,025; 3,256,185; 3,278,550; 3,282,955; 3,284,410; 3,338,832; 3,533,945; 3,639,242; 3,708,522; 3,859,318; 3,865,813; 4,234,435; etc. U.K. Patent Nos. 1,085,903 and 1,162,436 also describe such processes.

In one embodiment, the dispersants are post-treated with at least one boron compound. The reaction of the dispersant with the boron compounds can be effected simply by mixing the reactants at the desired temperature. Ordinarily it is preferably between about 50° C. and about 250° C. In some instances it may be 25° C. or even lower. The upper limit of the temperature is the decomposition point of the particular reaction mixture and/or product.

The amount of boron compound reacted with the dispersant generally is sufficient to provide from about 0.1 to about 10 atomic proportions of boron for each mole of dispersant, i.e., the atomic proportion of nitrogen or hydroxyl group contained in the dispersant. The preferred amounts of reactants are such as to provide from about 0.5 to about 2 atomic proportions of boron for each mole of dispersant. To illustrate, the amount of a boron compound having one boron atom per molecule to be used with one mole of an amine dispersant having five nitrogen atoms per molecule is within the range from about 0.1 mole to about 50 moles, preferably from about 0.5 mole to about 10 moles.

C) Metal Dihydrocarbyl Dithiophosphate

The oil compositions of the present invention also contain (C) at least one metal dihydrocarbyl dithiophosphate characterized by the formula

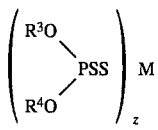

wherein $R^3$ and $R^4$ are each independently hydrocarbyl groups containing from 3 to about 13 carbon atoms, preferably from 3 to about 8, M is a metal, and z is an integer equal to the valence of M.

The hydrocarbyl groups $R^3$ and $R^4$ in the dithiophosphate may be alkyl, cycloalkyl, aralkyl or alkaryl groups. Illustrative alkyl groups include isopropyl, isobutyl, n-butyl, sec-butyl, the various amyl groups, n-hexyl, methylisobutyl carbinyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

The phosphorodithioic acids from which the metal salts useful in this invention are prepared are well known. Examples of dihydrocarbyl phosphorodithioic acids and metal salts, and processes for preparing such acids and salts are found in, for example, U.S. Pat. Nos. 4,263,150; 4,289,635; 4,308,154; and 4,417,990. These patents are hereby incorporated by reference for such disclosures.

The phosphorodithioic acids are prepared by the reaction of phosphorus pentasulfide with an alcohol or phenol or mixtures of alcohols. The reaction involves four moles of the alcohol or phenol per mole of phosphorus pentasulfide, and may be carried out within the temperature range from about 50° C. to about 200° C. Thus the preparation of O,O-di-n-hexyl phosphorodithioic acid involves the reaction of phosphorus pentasulfide with four moles of n-hexyl alcohol at about 100° C. for about two hours. Hydrogen sulfide is liberated and the residue is the defined acid. The preparation of the metal salt of this acid may be effected by reaction with metal oxide. Simply mixing and heating these two reactants is sufficient to cause the reaction to take place and the resulting product is sufficiently pure for the purposes of this invention.

The metal salts of dihydrocarbyl dithiophosphates which are useful in this invention include those salts containing Group I metals, Group II metals, aluminum, lead, tin, molybdenum, manganese, cobalt, and nickel. Group I and Group II (including Ia, Ib, IIa and IIb are defined in the Periodic Table of the Elements in the Merck Index, 9th Edition (1976). The Group II metals, aluminum, tin, iron, cobalt, lead, molybdenum, manganese, nickel and copper are among the preferred metals. Zinc and copper are especially useful metals. In one embodiment, the lubricating compositions contain a zinc dihydrocarbyl dithiophosphate and a copper dihydrocarbyl dithiophosphate. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontiumhydroxide, cadmium oxide, cadmium hydroxide, barium oxide, aluminum oxide, iron carbonate, copper hydroxide, copper oxide, lead hydroxide, tin butylate, cobalt hydroxide, nickel hydroxide, nickel carbonate, zinc oxide, etc.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate.

In one preferred embodiment, the alkyl groups $R^3$ and $R^4$ are derived from secondary alcohols such as isopropyl alcohol, secondary butyl alcohol, 2-pentanol, 2-methyl-4-pentanol, 2-hexanol, 3-hexanol, etc.

Especially useful metal phosphorodithioates can be prepared from phosphorodithioic acids which in turn are prepared by the reaction of phosphorus pentasulfide with mixtures of alcohols. In addition, the use of such mixtures enables the utilization of cheaper alcohols which in themselves may not yield oil-soluble phosphorodithioic acids or salts thereof. Thus a mixture of isopropyl and hexyl alcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 2-methyl-4-pentanol; isopropanol and sec-butyl alcohol; isopropanol and isooctyl alcohol; etc. Particularly useful alcohol mixtures are mixtures of secondary alcohols containing at least about 20 mole percent of isopropyl alcohol, and in a preferred embodiment, at least 40 mole percent of isopropyl alcohol.

Generally, the oil compositions of the present invention will contain varying amounts of one or more of the above-identified metal dithiophosphates such as from about 0.01 to about 2% by weight, and more generally from about 0.01 to about 1% by weight based on the weight of the total oil composition. The metal dithiophosphates are added to the lubricating oil compositions of the invention to improve the anti-wear and antioxidant properties of the oil compositions.

The following examples illustrate the preparation of metal phosphorodithioates.

EXAMPLE C-1

A phosphorodithioic acid is prepared by reacting a mixture of alcohols comprising 6 moles of 4-methyl-2-pentanol and 4 moles of isopropyl alcohol with phosphorus pentasulfide. The phosphorodithioic acid then is reacted with an oil slurry of zinc oxide. The amount of zinc oxide in the slurry is about 1.08 times the theoretical amount required to completely neutralize the phosphorodithioic acid. The oil solution of the zinc phosphorodithioate obtained in this manner (10% oil) contains 9.5% phosphorus, 20.0% sulfur and 10.5% zinc.

Additional specific examples of metal phosphorodithioates useful in the lubricating oils of the present invention are listed in the following table. These metal dithiophosphates are prepared by the general procedure of Example C-1.

TABLE

Component C: Metal Phosphorodithioates

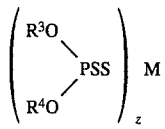

| Example | $R^3$ | $R^4$ | M | z |
|---|---|---|---|---|
| C-2 | (isopropyl + isooctyl) $(60:40)_m$ | | Zn | 2 |
| C-3 | n-nonyl | n-nonyl | Ba | 2 |
| C-4 | cyclohexyl | cyclohexyl | Zn | 2 |
| C-5 | isobutyl | isobutyl | Zn | 2 |
| C-6 | hexyl | hexyl | Ca | 2 |
| C-7 | n-decyl | n-decyl | Zn | 2 |
| C-8 | 4-methyl-2-pentyl | 4-methyl-2-pentyl | Cu | 2 |
| C-9 | (n-butyl + dodecyl) (1:1)w | | Zn | 2 |
| C-10 | (isopropyl + isooctyl) (1:1)w | | Ba | 2 |
| C-11 | (isopropyl + 4-methyl-2 pentyl) + (40:60)m | | Cu | 2 |
| C-12 | (isobutyl + isoamyl) (65:35)m | | Zn | 2 |
| C-13 | (isopropyl + sec-butyl) (40:60)m | | Zn | 2 |

Another class of the phosphorodithioate additives contemplated for use in the lubricating composition of this invention comprises the adducts of the metal phosphorodithioates described above with an epoxide. The metal phosphorodithioates useful in preparing such adducts are for the most part the zinc phosphorodithioates. The epoxides may be alkylene oxides or arylalkylene oxides. The arylalkylene oxides are exemplified by styrene oxide, p-ethylstyrene oxide, alpha-methylstyrene oxide, 3-beta-naphthyl-1,1,3-butylene oxide, m-dodecylstyrene oxide, and p-chlorostyrene oxide. The alkylene oxides include principally the lower alkylene oxides in which the alkylene radical contains 8 or less carbon atoms. Examples of such lower alkylene oxides are ethylene oxide, propylene oxide, 1,2-butene oxide, trimethylene oxide, tetramethylene oxide, butadiene monoepoxide, 1,2-hexene oxide, and epichlorohydrin. Other epoxides useful herein include, for example, butyl 9,10-epoxy-stearate, epoxidized soya bean oil, epoxidized tung oil, and epoxidized copolymer of styrene with butadiene.

The adduct may be obtained by simply mixing the metal phosphorodithioate and the epoxide. The reaction is usually exothermic and may be carried out within wide temperature limits from about 0° C. to about 300° C. Because the reaction is exothermic, it is best carried out by adding one reactant, usually the epoxide, in small increments to the other reactant in order to obtain convenient control of the temperature of the reaction. The reaction may be carried out in a solvent such as benzene, toluene, xylene, mineral oil, naphtha, or n-hexene.

The chemical structure of the adduct is not known. For the purpose of this invention adducts obtained by the reaction of one mole of the phosphorodithioate with from about 0.25 mole to 5 moles, usually up to about 0.75 mole or about 0.5 mole of a lower alkylene oxide, particularly ethylene oxide and propylene oxide, have been found to be especially useful and therefore are preferred.

The preparation of such adducts is more specifically illustrated by the following examples.

EXAMPLE C-14

A reactor is charged with 2365 parts (3.33 moles) of the zinc isopropyl-isooctyl phosphorodithioate (wherein the molar ratio of isopropyl to isooctyl is (1:0.7)), and while stirring at room temperature, 38.6 parts (0.67 mole) of propylene oxide are added with an exotherm of from 24°–31° C. The mixture is maintained at 80°–90° C. for 3 hours and then vacuum stripped to 101° C. at 7 mm. Hg. The residue is filtered using a filter aid, and the filtrate is an oil solution (11.8% oil) of the desired salt containing 17.1% sulfur, 8.17% zinc and 7.44% phosphorus.

Another class of the phosphorodithioate additives contemplated as useful in the lubricating compositions of the invention comprises mixed metal salts of (a) at least one phosphorodithioic acid as defined above and (b) at least one aliphatic or alicyclic carboxylic acid. The carboxylic acid may be a monocarboxylic or polycarboxylic acid, usually containing from 1 to about 3 carboxy groups, preferably one. It may contain from about 2 to about 40, preferably from about 2 to about 20 carbon atoms, and advantageously about 5 to about 20 carbon atoms. The carboxylic acid may be any of the above-described carboxylic acids. The preferred carboxylic acids are those having the formula $R^5COOH$, wherein $R^5$ is an aliphatic or alicyclic hydrocarbon-based radical preferably free from acetylenic unsaturation. Suitable acids include the butanoic, pentanoic, hexanoic, octanoic, nonanoic, decanoic, dodecanoic, octadecanoic and eicosanoic acids, as well as olefinic acids such as oleic, linoleic, and linolenic acids and linoleic acid dimer For the most part, $R^5$ is a saturated aliphatic group and especially a branched alkyl group such as the isopropyl or 3-heptyl group. Illustrative polycarboxylic acids are succinic, alkyl- and alkenylsuccinic, adipic, sebacic and citric acids.

The mixed metal salts may be prepared by merely blending a metal salt of a phosphorodithioic acid with a metal salt of a carboxylic acid in the desired ratio. The ratio of equivalents of phosphorodithioic to carboxylic acid salts is between about 0.5:1 to about 400:1. Preferably, the ratio is between about 0.5:1 and about 200:1. Advantageously, the ratio can be from about 0.5:1 to about 100:1, preferably from about 0.5:1 to about 50:1, and more preferably from about 0.5:1 to about 20:1. Further, the ratio can be from about 0.5:1 to about 4.5:1, preferably about 2.5:1 to about 4.25:1. For this purpose, the equivalent weight of a phosphorodithioic acid is its molecular weight divided by the number of —PSSH groups therein, and that of a carboxylic acid is its molecular weight divided by the number of carboxy groups therein.

A second and preferred method for preparing the mixed metal salts useful in this invention is to prepare a mixture of the acids in the desired ratio and to react the acid mixture with one of the above described metal compounds. When this method of preparation is used, it is frequently possible to prepare a salt containing an excess of metal with respect to the number of equivalents of acid present; thus, mixed metal salts containing as many as 2 equivalents and especially up to about 1.5 equivalents of metal per equivalent of acid may be prepared. The equivalent of a metal for this purpose is its atomic weight divided by its valence.

Variants of the above-described methods may also be used to prepare the mixed metal salts useful in this invention. For example, a metal salt of either acid may be blended with an acid of the other, and the resulting blend reacted with additional metal base.

The temperature at which the mixed metal salts are prepared is generally between about 30° C. and about 150° C., preferably up to about 125° C. If the mixed salts are prepared by neutralization of a mixture of acids with a metal base, it is preferred to employ temperatures above about 50° C. and especially above about 75° C. It is frequently advantageous to conduct the reaction in the presence of a substantially inert, normally liquid organic diluent such as naphtha, benzene, xylene, mineral oil or the like. If the diluent is mineral oil or is physically and chemically similar to mineral oil, it frequently need not be removed before using the mixed metal salt as an additive for lubricants or functional fluids.

U.S. Pat. Nos. 4,308,154 and 4,417,990 describe procedures for preparing these mixed metal salts and disclose a number of examples of such mixed salts. Such disclosures of these patents are hereby incorporated by reference.

The preparation of the mixed salts is illustrated by the following example.

EXAMPLE C-15

A mixture of 67 parts (1.63 equivalents) of zinc oxide and 48 parts of mineral oil is stirred at room temperature and a mixture of 401 parts (1 equivalent) of di-(2-ethylhexyl) phosphorodithioic acid and 36 parts (0.25 equivalent) of 2-ethylhexanoic acid is added over 10 minutes. The temperature increases to 40° C. during the addition. When addition is complete, the temperature is increased to 80° C. for 3 hours. The mixture is then vacuum stripped at 100° C. to yield the desired mixed metal salt as a 91% solution in mineral oil.

D) An Antioxidant

The compositions of the present invention also include an antioxidant (D), with the proviso that (D) the antioxidant and (C) the metal dithiophosphate are not the same. For instance, (C) and (D) may both be metal dithiophosphates provided that the metal of (C) is not the same as the metal of (D). The antioxidants are selected from the group consisting of sulfur-containing compositions, alkylated aromatic amines, phenols, and oil-soluble transition metal containing compounds.

The antioxidant also may be one or more sulfur-containing compositions. Materials which may be sulfurized to form the sulfurized organic compositions of the present invention include oils, fatty acids or esters, olefins or polyolefins made thereof or Diels-Alder adducts.

Oils which may be sulfurized are natural or synthetic oils including mineral oils, lard oil, carboxylic acid esters derived from aliphatic alcohols and fatty acids or aliphatic carboxylic acids (e.g., myristyl oleate and oleyl oleate) sperm whale oil, synthetic sperm whale oil substitutes and synthetic unsaturated esters or glycerides.

Fatty acids generally contain from about 8 to about 30 carbon atoms. The unsaturated fatty acids generally contained in the naturally occurring vegetable or animal fats and such acids include palmitoleic acid, oleic acid, linoleic acid, linolenic acid, and erucic acid. The fatty acids may comprise mixtures of acids, such as those obtained from naturally occurring animal and vegetable oils, including beef tallow, depot fat, lard oil, tall oil, peanut oil, corn oil, safflower oil, sesame oil, poppy-seed oil, soybean oil, cottonseed oil, sunflower seed oil, or wheat germ oil. Tall oil is a mixture of rosin acids, mainly abietic acid, and unsaturated fatty acids, mainly oleic and linoleic acids. Tall oil is a by-product of the sulfate process for the manufacture of wood pulp.

The fatty acid esters also may be prepared from aliphatic olefinic acids of the type described above by reaction with any of the above-described alcohols and polyols. Examples of aliphatic alcohols include monohydric alcohols such as methanol, ethanol; n- or isopropanol; n-, iso-, sec-, or tertbutanol, etc.; and polyhydric alcohols including ethylene glycol, propylene glycol, trimethylene glycol, neopentyl glycol, glycerol, etc.

The olefinic compounds which may be sulfurized are diverse in nature. They contain at least one olefinic double bond, which is defined as a non-aromatic double bond; that is, one connecting two aliphatic carbon atoms. In its broadest sense, the olefin may be defined by the formula $R^{*1}R^{*2}C{=}CR^{*3}R^{*4}$, wherein each of $R^{*1}$, $R^{*2}$, $R^{*3}$ and $R^{*4}$ is hydrogen or an organic group. In general, the R* groups in the above formula which are not hydrogen may be satisfied by such groups as $—C(R^{*5})_3$, $—COOR^{*5}$, $—CON(R^{*5})_2$, $—COON(R^{*5})_4$, —COOM, —CN, —X, $—YR^{*5}$ or —Ar, wherein:

each $R^{*5}$ is independently hydrogen, alkyl, alkenyl, aryl, substituted alkyl, substituted alkenyl or substituted aryl, with the proviso that any two $R^{*5}$ groups can be alkylene or substituted alkylene whereby a ring of up to about 12 carbon atoms is formed;

M is one equivalent of a metal cation (preferably Group I or II, e.g., sodium, potassium, barium, calcium);

X is halogen (e.g., chloro, bromo, or iodo);

Y is oxygen or divalent sulfur;

Ar is an aryl or substituted aryl group of up to about 12 carbon atoms.

Any two of $R^{*1}$, $R^{*2}$, $R^{*3}$ and $R^{*4}$ may also together form an alkylene or substituted alkylene group; i.e., the olefinic compound may be alicyclic.

The olefinic compound is usually one in which each R group which is not hydrogen is independently alkyl, alkenyl or aryl group. Monoolefinic and diolefinic compounds, particularly the former, are preferred, and especially terminal monoolefinic hydrocarbons; that is, those compounds in which $R^{*3}$ and $R^{*4}$ are hydrogen and $R^{*1}$ and $R^{*2}$ are alkyl or aryl, especially alkyl (that is, the olefin is aliphatic) having 1 to about 30, preferably 1 to about 16, more preferably 1 to about 8, and more preferably 1 to about 4 carbon atoms. Olefinic compounds having about 3 to 30 and especially about 3 to 16 (most often less than 9) carbon atoms are particularly desirable.

Isobutene, propylene and their dimers, trimers and tetramers, and mixtures thereof are especially preferred olefinic compounds. Of these compounds, isobutylene and diisobutylene are particularly desirable because of their availability and the particularly high sulfur containing compositions which can be prepared therefrom.

In another embodiment, the sulfurized organic compound is a sulfurized terpene compound. The term "terpene compound" as used in the specification and claims is intended to include the various isomeric terpene hydrocarbons having the empirical formula $C_{10}H_{16}$, such as contained in turpentine, pine oil and dipentenes, and the various synthetic and naturally occuring oxygen-containing derivatives. Mixtures of these various compounds generally will be utilized, especially when natural products such as pine oil and turpentine are used. Pine oil, for example, comprises a mixture of alpha-terpineol, beta-terpineol, alpha-fenchol, camphor, borneol/isoborneol, fenchone, estragole, dihydro alpha-terpineol, anethole, and other mono-terpene hydrocarbons. The specific ratios and amounts of the various components in a given pine oil will depend upon the particular source and the degree of purification. A group of pine oil-derived products are available commercially from Hercules Incorporated. It has been found that the pine oil products generally known as terpene alcohols available from Hercules Incorporated are particularly useful in the preparation of the sulfurized products of the invention. Pine oil products are available from Hercules under such designations as alpha-Terpineol, Terpineol 318 Prime, Yarmor 302, Herco pine oil, Yarmor 302W, Yarmor F and Yarmor 60.

In another embodiment, the sulfurized organic composition is at least one sulfur-containing material which comprises the reaction product of a sulfur source and at least one Diels-Alder adduct. Generally, the molar ratio of sulfur source to Diels-Alder adduct is in a range of from about 0.75 to about 4.0, preferably about 1 to about 2.0, more preferably about 1 to about 1.8. In one embodiment the molar ratio of sulfur to adduct is from about 0.8:1 to 1.2:1.

The Diels-Alder adducts are a well-known, art-recognized class of compounds prepared by the diene synthesis or Diels-Alder reaction. A summary of the prior art relating to this class of compounds is found in the Russian monograph, *Dienovyi Sintes*, Izdatelstwo Akademii Nauk SSSR, 1963 by A. S. Onischenko. (Translated into the English language by L. Mandel as A. S. Onischenko, *Diene Synthesis*, New York., Daniel Davey and Co., Inc., 1964.) This monograph and references cited therein are incorporated by reference into the present specification.

Basically, the diene synthesis (Diels-Alder reaction) involves the reaction of at least one conjugated diene with at least one ethylenically or acetylenically unsaturated compound, these latter compounds being known as dienophiles. Piperylene, isoprene, methylisoprene, chloroprene, and 1,3-butadiene are among the preferred dienes for use in preparing the Diels-Alder adducts. Examples of cyclic dienes are the cyclopentadienes, fulvenes, 1,3-cyclohexadienes, 1,3-cycloheptadienes, 1,3,5-cycloeptatrienes, cyclooctatetraene, and 1,3,5-cyclononatrienes.

A preferred class of dienophiles are those having at least one electron-accepting groups selected from groups such as formyl, cyano, nitro, carboxy, carbohydrocarbyloxy, etc. Usually the hydrocarbyl and substituted hydrocarbyl groups, if not present, will not contain more than 10 carbon atoms each.

One preferred class of dienophiles are those wherein at least one carboxylic ester group represented by $—C(O)O—R_o$ where $R_o$ is the residue of a saturated aliphatic alcohol of up to about 40 carbon atoms, the aliphatic alcohol from which $—R_o$ is derived can be any of the above-described mono or polyhydric alcohols. Preferably the alcohol is a lower aliphatic alcohol, more preferably methanol, ethanol, propanol, or butanol.

In addition to the ethylenically unsaturated dienophiles, there are many useful acetylenically unsaturated dienophiles such as propiolaldehyde, methyl-ethynylketone, propylethynylketone, propenylethynylketone, propiolic acid, propiolic acid nitrile, ethyl-propiolate, tetrolic acid, propargylaldehyde, acetylene-dicarboxylic acid, the dimethyl ester of acetylenedicarboxylic acid, dibenzoylacetylene, and the like.

Normally, the adducts involve the reaction of equimolar amounts of diene and dienophile. However, if the dienophile has more than one ethylenic linkage, it is possible for additional diene to react if present in the reaction mixture.

It is frequently advantageous to incorporate materials useful as sulfurization promoters in the reaction mixture.

These materials may be acidic, basic or neutral. Useful neutral and acidic materials include acidified clays such as "Super Filtrol" (sulfuric acid treated diatomaceous earth), p-toluenesulfonic acid, phosphorus-containing reagents such as phosphorus acids (e.g., dialkyl-phosphorodithioic acids, phosphorus acid esters (e.g., triphenyl phosphate), phosphorus sulfides such as phosphorus pentasulfide and surface active agents such as lecithin.

The preferred promoters are basic materials. These may be inorganic oxides and salts such as sodium hydroxide, calcium oxide and sodium sulfide. The most desirable basic promoters, however, are nitrogen bases including ammonia and amines.

The amount of promoter material used is generally about 0.0005–2.0% of the combined weight of the terpene and olefinic compounds. In the case of the preferred ammonia and amine catalysts, about 0.0005–0.5 mole per mole of the combined weight is preferred, and about 0.001–0.1 is especially desirable.

Water is also present in the reaction mixture either as a promoter or as a diluent for one or more of the promoters recited hereinabove. The amount of water, when present, is usually about 1–25% by weight of the olefinic compound. The presence of water is, however, not essential and when certain types of reaction equipment are used it may be advantageous to conduct the reaction under substantially anhydrous conditions.

When promoters are incorporated into the reaction mixture as described hereinabove, it is generally observed that the reaction can be conducted at lower temperatures, and the product generally is lighter in color.

The sulfur source or reagent used for preparing any of the sulfur-containing materials of this invention may be, for example, sulfur, a sulfur halide such as sulfur monochloride or sulfur dichloride, a mixture of hydrogen sulfide and sulfur or sulfur dioxide, or the like. Sulfur, or mixtures of sulfur and hydrogen sulfide often are preferred. However, it will be understood that other sulfurization reagents may, when appropriate, be substituted therefor. Commercial sources of all the sulfurizing reagents are normally used for the purpose of this invention, and impurities normally associated with these commercial products may be present without adverse results.

When the sulfurization reaction is effected by the use of sulfur alone, the reaction is effected by merely heating the reagents with the sulfur at temperatures of from about 50° to 250° C., usually, from about 150° to about 210° C. The weight ratio of the materials to be sulfurized to sulfur is between about 5:1 and about 15:1, generally between about 5:1 and about 10:1. The sulfurization reaction is conducted with efficient agitation and generally in an inert atmosphere (e.g., nitrogen). If any of the components or reagents are appreciably volatile at the reaction temperature, the reaction vessel may be sealed and maintained under pressure. It is frequently advantageous to add the sulfur portionwise to the mixture of the other components.

When mixtures of sulfur and hydrogen sulfide are utilized in the process of the invention, the amounts of sulfur and hydrogen sulfide per mole of component(s) to be sulfurized are, respectively, usually about 0.3 to about 3 gram-atoms and about 0.1 to about 1.5 moles. A preferred range is from about 0.5 to about 2.0 gram-atoms and about 0.4 to about 1.25 moles, respectively, and the most desirable ranges are about 0.8 to about 1.8 gram-atoms, and about 0.4 to about 0.8 mole, respectively. In reaction mixture operations, the components are introduced at levels to provide these ranges. In semi-continuous operations, they may be admixed at any ratio, but on a mass balance basis, they are present so as to be consumed in amounts within these ratios. Thus, for example, if the reaction vessel is initially charged with sulfur alone, the terpene and/or olefinic compound and hydrogen sulfide are added incrementally at a rate such that the desired ratio is obtained.

When mixtures of sulfur and hydrogen sulfide are utilized in the sulfurization reaction, the temperature range of the sulfurization reaction is generally from about 50° to about 350° C. The preferred range is about 100° to about 200° C. with about 120° to about 180° C. being especially suitable. The reaction often is conducted under super atmospheric pressure which may be and usually is autogenous pressure (i.e., pressure which naturally developed during the course of the reaction), but may also be externally applied pressure. The exact pressure developed during the reaction is dependent upon such factors as design and operation of the system, the reaction temperature, and the vapor pressure of the reactants and products, and it may vary during the course of the reaction.

While it is preferred generally that the reaction mixture consists entirely of the components and reagents described above, the reaction also may be effected in the presence of an inert solvent (e.g., an alcohol, ether, ester, aliphatic hydrocarbon, halogenated aromatic hydrocarbon, etc.) which is liquid within the temperature range employed. When the reaction temperature is relatively high, for example, at about 200° C., there may be some evolution of sulfur from the product which is avoided is a lower reaction temperature such as from about 150°–170° C. is used.

In some instances, it may be desirable to treat the sulfurized product obtained in accordance with the procedures described herein to reduce active sulfur. The term "active sulfur" includes sulfur in a form which can cause staining of copper and similar materials, and standard tests are available to determine sulfur activity. As an alternative to the treatment to reduce active sulfur, metal deactivators can be used with the lubricants containing sulfurized compositions.

The following examples relate to sulfurized compositions of the present invention.

EXAMPLE D-1

A reaction vessel is charged with 780 parts isopropyl alcohol, 752 parts water, 35 parts of a 50% by weight aqueous solution of sodium hydroxide, 60 parts of sulfuric acid treated diatomaceous earth (Super Filtrol available from Engelhard Corporation, Menlo Park, N.J.) and 239 parts of sodium sulfide. The mixture is stirred and heated to 77°–80° C. The reaction temperature is maintained for two hours. The mixture is cooled to 71° C. where 1000 parts of the sulfurized olefin prepared by reacting 337 parts of sulfur monochloride with 1000 parts of a mixture of 733 parts of 1-dodecene and 1000 parts of Neodene 1618, a $C_{16-18}$ olefin mixture available from Shell Chemical, is added to the mixture. The reaction mixture is heated to 77°–80° C. and the temperature is maintained until the chlorine content is a maximum of 0.5. The reaction mixture is vacuum stripped to 80° C. and 20 millimeters of mercury. The residue is filtered through diatomaceous earth. The filtrate has 19.0% sulfur and a specific gravity of 0.95.

EXAMPLE D-2

A mixture of 100 parts of soybean oil and 50 parts of commercial $C_{16}$ α-olefins is heated to 175° C. under nitrogen and 17.4 parts of sulfur is added gradually, whereupon an exothermic reaction causes the temperature to rise to 205°

C. The mixture is heated at 188°–200° C. for 5 hours, allowed to cool gradually to 90° C. and filtered to yield the desired product containing 10.13% sulfur.

EXAMPLE D-3

A mixture of 100 parts of soybean oil, 3.7 parts of tall oil acid and 46.3 parts of commercial $C_{15-18}$ α-olefins is heated to 165° C. under nitrogen and 17.4 parts of sulfur is added. The temperature of the mixture rises to 191° C. It is maintained at 165°–200° C. for 7 hours and is then cooled to 90° C. and filtered. The product contains 10.13% sulfur.

EXAMPLE D-4

A mixture of 93 parts (0.5 equivalent) of pine oil and 48 parts (1.5 equivalents) of sulfur is charged to a reaction vessel equipped with condenser, thermometer and stirrer. The mixture is heated to about 140° C. with nitrogen blowing and maintained at this temperature for about 28 hours. After cooling, 111 parts of a $C_{16}$ alpha-olefin (available from Gulf Oil Chemicals Company under the general trade name Gulftene 16) are added through an addition funnel, and after addition is complete, the addition funnel is replaced with a nitrogen tube. The reaction mixture is heated to 170° C. with nitrogen blowing and maintained at the temperature for about 5 hours. The mixture is cooled and filtered through a filter aid. The filtrate is the desired product having a sulfur content of 19.01% (theory 19.04%).

EXAMPLE D-5

(a) A mixture comprising 400 grams of toluene and 66.7 grams of aluminum chloride is charged to a two-liter flask fitted with a stirrer, nitrogen inlet tube, and a solid carbon dioxide-cooled reflux condenser. A second mixture comprising 640 grams (5 moles) of butylacrylate and 240.8 grams of toluene is added to the $AlCl_3$ slurry over a 0.25-hour period while maintaining the temperature within the range of 37°–58° C. Thereafter, 313 grams (5.8 moles) of butadiene are added to the slurry over a 2.75-hour period while maintaining the temperature of the reaction mass at 60°–61° C. by means of external cooling. The reaction mass is blown with nitrogen for about 0.33-hour and then transferred to a four-liter separatory funnel and washed with a solution of 150 grams of concentrated hydrochloric acid in 1100 grams of water. Thereafter, the product is subjected to two additional water washings using 1000 ml of water for each wash. The washed reaction product is subsequently distilled to remove unreacted butylacrylate and toluene. The residue of this first distillation step is subjected to further distillation at a pressure of 9–10 millimeters of mercury whereupon 785 grams of the desired adduct are collected over the temperature of 105°–115° C.

(b) A butadiene-butylacrylate Diels-Alder adduct (4550 grams, 25 moles) and 1600 grams (50 moles) of sulfur flowers are charged to a 12 liter flask, fitted with stirrer, reflux condenser, and nitrogen inlet tube. The reaction mixture is heated at a temperature within the range of 150°–155° C. for 7 hours while passing nitrogen therethrough at a rate of about 0.5 cubic feet per hour. After heating, the mass is permitted to cool to room temperature and filtered, the sulfur-containing product being the filtrate.

Component (D) may also be an alkylated aromatic amine. Alkylated aromatic amines include compounds represented by the formula

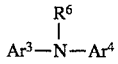

wherein $Ar^3$ and $Ar^4$ are independently mononuclear or polynuclear, substituted or unsubstituted aromatic groups; and $R^6$ is hydrogen, halogen, OH, $NH_2$, SH, $NO_2$ or a hydrocarbyl group of from 1 to about 50 carbon atoms. $Ar^3$ and $Ar^4$ may be any of the above-described aromatic groups. When $Ar^3$ and/or $Ar^4$ are substituted aromatic groups, the number of substituents on $Ar^3$ and/or $Ar^4$ range independently up to the number of positions available on $Ar^3$ and/or $Ar^4$ for substitution. These substituents are independently selected from the group consisting of halogen (e.g., chlorine, bromine, etc.), OH, $NH_2$, SH, $NO_2$ or hydrocarbyl groups of from 1 to about 50 carbon atoms.

In a preferred embodiment, component (D) is represented by the formula

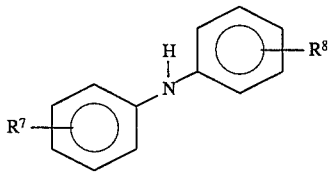

wherein $R^7$ and $R^8$ are independently hydrogen or hydrocarbyl groups of from 1 to about 50 carbon atoms, preferably hydrocarbyl groups of from about 4 to about 20 carbon atoms. Examples of aromatic amines include P,P'-dioctyldiphenylamine; octylphenyl-beta-naphthylamine; octylphenylalpha-naphthylamine, phenyl-alpha-naphthylamine; phenylbeta-naphthylamine; p-octylphenyl-alpha-naphthylamine and 4-octylphenyl-1-octyl-beta-naphthylamine and di(nonylatedphenyl)amine, with di(nonylphenyl)amine preferred.

U.S. Pat. Nos. 2,558,285; 3,601,632; 3,368,975; and 3,505,225 disclose diarylamines within the scope of component (D). These patents are incorporated herein by reference.

The antioxidants (D) of the present invention may contain one or more of several types of phenolic compounds which may be metal-free phenolic compounds or neutral or basic metal salts of certain phenolic compounds. Preferably the phenolic compounds are metal-free.

In one embodiment, the antioxidant of the present invention includes at least one metal-free hindered phenol. Alkylene coupled derivatives of said hindered phenols also can be used. Hindered phenols are defined (in the specification and claims) as those containing a sterically hindered hydroxyl group, and these include those derivatives of dihydroxy aryl compounds wherein the hydroxyl groups are in the o- or p-position to each other.

The metal-free hindered phenols may be represented by the following Formulae I, II and III.

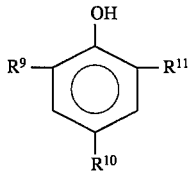

(I)

-continued

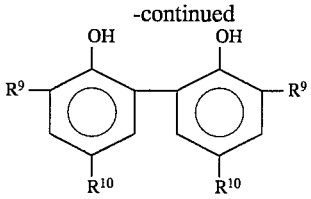

(II)

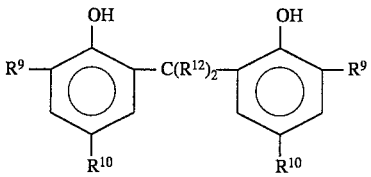

(III)

wherein each $R^9$ is independently an alkyl group containing from 3 to about 9 carbon atoms, each $R^{10}$ is hydrogen or an alkyl group, $R^{11}$ is hydrogen or an alkyl group containing from 1 to about 9 carbon atoms, and each $R^{12}$ is independently hydrogen or a methyl group. In the preferred embodiment, $R^{10}$ is an alkyl group containing from about 3 to about 50 carbon atoms, preferably about 6 to about 20, more preferably from about 6 to about 12. Examples of such groups include hexyl, heptyl, octyl, decyl, dodecyl, tripropenyl, tetrapropenyl, etc. Examples of $R^9$, $R^{10}$ and $R^{11}$ groups include propyl, isopropyl, butyl, secondary butyl, tertiary butyl, heptyl, octyl, and nonyl. Preferably, each $R^9$ and $R^{11}$ are tertiary groups such as tertiary butyl, tertiary amyl, etc. The phenolic compounds of the type represented by Formula I may be prepared by various techniques, and in one embodiment, such phenols are prepared in stepwise manner by first preparing the para-substituted alkyl phenol, and thereafter alkylating the para-substituted phenol in the 2- and/or 6-position as desired. When it is desired to prepare coupled phenols of the type represented by Formulae II and III, the second step alkylation is conducted under conditions which result in the alkylation of only one of the positions ortho to the hydroxyl group. Examples of useful phenolic materials of the type represented by Formula I include: 2-t-butyl-4-heptyl phenol; 2-t-butyl-4-octyl phenol; 2-t-butyl-4-dodecyl phenol; 2,6-di-t-butyl-4-butylphenol; 2,6-di-t-butyl-4-heptyl phenol; 2,6-di-t-butyl-4-dodecyl phenol; 2-methyl-6-di-t-butyl-4-heptyl phenol; 2,4-dimethyl-6-t-butyl phenol; 2,6-t-butyl-4-ethyl phenol; 4-t-butyl catechol; 2,4-di-t-butyl-p-cresol; 2,6-di-t-butyl-4-methyl phenol; and 2-methyl-6-di-t-butyl-4-dodecyl phenol.

Examples of the ortho coupled phenols of the type represented by Formula II include: 2,2'-bis(6-t-butyl-4-heptyl phenol); 2,2'-bis(6-t-butyl-4-octyl phenol); 2,6 -bis-(1'-methylcyclohexyl)-4-methyl phenol; and 2,2'-bis(6 -t-butyl-4-dodecyl phenol).

Alkylene-coupled phenolic compounds of the type represented by Formula III can be prepared from the phenols represented by Formula I wherein $R^{11}$ is hydrogen by reaction of the phenolic compound with an aldehyde such as formaldehyde, acetaldehyde, etc. or a ketone such as acetone. Procedures for coupling of phenolic compounds with aldehydes and ketones are well known in the art, and the procedures do not need to be described in detail herein. To illustrate the process, the phenolic compound of the type represented by Formula I wherein $R^{11}$ is hydrogen is heated with a base in a diluent such as toluene or xylene, and this mixture is then contacted with the aldehyde or ketone while heating the mixture to reflux and removing water as the reaction progresses. Examples of phenolic compounds of the type represented by Formula III include 2,2'-methylene-bis(6-t-butyl-4-heptylphenol); 2,2'-methylene-bis(6-t-butyl-4-octyl phenol); 2,2'-methylene-bis-(4-dodecyl-6-t-butyl phenol); 2,2'-methylene-bis-(4-octyl-6 -t-butyl phenol); 2,2'-methylene-bis-(4-octyl phenol); 2,2'-methylene-bis-(4-dodecyl phenol); 2,2'-methylene-bis(4-heptyl phenol); 2,2'-methylene-bis(6-t-butyl-4-dodecyl phenol); 2,2'-methylene-bis(6-t-butyl-4-tetrapropenyl phenol); and 2,2'methylene-bis(6-t-butyl-4-butyl phenol).

The alkylene-coupled phenols may be obtained by reacting a phenol (2 equivalents) with 1 equivalent of an aldehyde or ketone. Lower molecular weight aldehydes are preferred and particularly preferred examples of useful aldehydes include formaldehyde, a reversible polymer thereof such as paraformaldehyde, trioxane, acetaldehyde, etc. As used in this specification and claims, the word "formaldehyde" shall be deemed to include such reversible polymers. The alkylene-coupled phenols can be derived from phenol or substituted alkyl phenols, and substituted alkyl phenols are preferred. The phenol must have an ortho or para position available for reaction with the aldehyde.

In one embodiment, the phenol will contain one or more alkyl groups which may or may not result in a sterically hindered hydroxyl group. Examples of hindered phenols which can be used in the formation of the alkylene-coupled phenols include: 2,4-dimethylphenol; 2,4-di-t-butyl phenol, 2,6-di-t-butyl phenol; 4-octyl-6-t-butyl phenol; etc.

In one preferred embodiment, the phenol from which the alkylene-coupled phenols are prepared are phenols substituted in the para position with aliphatic groups containing at least 6 carbon atoms as described above. Generally, the alkyl groups contain from 6 to 12 carbon atoms. Preferred alkyl groups are derived from polymers of ethylene, propylene, 1-butene and isobutene, preferably propylene tetramer or trimer.

The reaction between the phenol and the aldehyde, polymer thereof or ketone is usually carried out between room temperature and about 150° C., preferably about 50°–125° C. The reaction preferably is carried out in the presence of an acidic or basic material such as hydrochloric acid, acetic acid, ammonium hydroxide, sodium hydroxide or potassium hydroxide. The relative amounts of the reagents used are not critical, but it is generally convenient to use about 0.3 to about 2.0 moles of phenol per equivalent of formaldehyde or other aldehyde.

The following examples illustrate the preparation of phenolic compounds of the type represented by Formulae I and III.

EXAMPLE D-6

A reaction vessel is charged with 3192 parts (12 moles) of a 4-tetrapropenyl phenol. The phenol is heated to 80° C. in 30 minutes and 21 parts (0.2 mole) of a 93% sulfuric acid solution is added to the vessel. The mixture is heated to 85° C. and 1344 parts (24 moles) of isobutylene is added over 6 hours. The temperature is maintained between 85°–91° C. After introduction of isobutylene, the reaction is blown with nitrogen at 2 standard cubic feet per hour for 30 minutes at 85° C. Calcium hydroxide (6 parts, 0.2 mole) along with 12 parts of water is added to the reaction vessel. The mixture is heated to 130° C. under nitrogen for 1.5 hours. The reaction is vacuum stripped at 130° C. and 20 millimeters of mercury for 30 minutes. The residue is cooled to 90° C. and the residue is filtered through diatomaceous earth to give the desired product. The desired product has a specific gravity of 0.901 and a percent hydroxyl (Grignard) equals 4.25 (theoretical 4.49).

EXAMPLE D-7

A reaction vessel is charged with 798 parts (3 moles) of 4-tetrapropenyl phenol. The phenol is heated to 95°–100° C.

where 5 parts of a 93% solution of sulfuric acid is added to the vessel. 168 parts (3 moles) of isobutylene is added to the vessel over 1.7 hours at 100° C. After introduction of the isobutylene the reaction is blown with nitrogen at 2 standard cubic feet per hour for one-half hour at 100° C. 890 parts of the above-described phenol (2.98 moles) is added to a reaction vessel and heated to 34°–40° C. A 37% aqueous formaldehyde solution (137 grams, 1.7 moles) is added to the vessel. The mixture is heated to 135° C. with removal of water. Nitrogen blowing at 1.5 scfh begins at 105°–110° C. The reaction is held at 120° C. for 3 hours under nitrogen. The reaction is cooled to 83° C. where 4 parts (0.05 mole) of a 50% aqueous sodium hydroxide solution is added to the vessel. The reaction is heated to 135° C. under nitrogen. The reaction is vacuum stripped to 135° C. and 20 millimeters of mercury for 10 minutes. The reaction is cooled to 95° C. and the residue is filtered through diatomaceous earth. The product has a percent hydroxyl (Grignard) of 5.47 (theoretical 5.5) and a molecular weight (vapor phase osmometry) of 682 (theoretical 667).

EXAMPLE D-8

The general procedure of Example D-6 is repeated except that the 4-heptyl phenol is replaced by an equivalent amount of tri-propylene phenol. The substituted phenol obtained in this manner contains 5.94% hydroxyl.

EXAMPLE D-9

The general procedure of Example D-7 is repeated except that the phenol of Example D-6 is replaced by the phenol of Example D-8. The methylene coupled phenol prepared in this manner contains 5.74% hydroxyl.

In another embodiment, the lubricant compositions of the present invention may contain a metal-free (or ashless) alkyl phenol sulfide.

The alkyl phenols from which the sulfides are prepared also may comprise phenols of the type discussed above and represented by Formula I wherein $R^{11}$ is hydrogen. For example, the alkyl phenols which can be converted to alkyl phenol sulfides include: 2-t-butyl-4-heptyl phenol; 2-t-butyl-4-octyl phenol; and 2-t-butyl-4-dodecyl phenol.

The term "alkylphenol sulfides" is meant to include di-(alkylphenol)monosulfides, disulfides, polysulfides, and other products obtained by the reaction of the alkylphenol with sulfur monochloride, sulfur dichloride or elemental sulfur. One mole of phenol is reacted with 0.5–1.5 moles, or higher, of sulfur compound. For example, the alkyl phenol sulfides are readily obtained by mixing, at a temperature above about 60° C., one mole of an alkylphenol and 0.5–2.0 moles of sulfur dichloride. The reaction mixture is usually maintained at about 100° C. for about 2–5 hours, after which time the resulting sulfide is dried and filtered. When elemental sulfur is used, temperatures of about 150°–200° C. or higher are typically used. It is also desirable that the drying operation be conducted under nitrogen or a similar inert gas.

Suitable basic alkyl phenol sulfides are disclosed, for example, in U.S. Pat. Nos. 3,372,116, 3,410,798 and 4,021,419, which are hereby incorporated by reference.

These sulfur-containing phenolic compositions described in U.S. Pat. No. 4,021,419 are obtained by sulfurizing a substituted phenol with sulfur or a sulfur halide and thereafter reacting the sulfurized phenol with formaldehyde or a reversible polymer thereof. Alternatively the substituted phenol can be first reacted with formaldehyde and thereafter reacted with sulfur or a sulfur halide to produce the desired alkyl phenol sulfide. The disclosure of U.S. Pat. No. 4,021,419 is hereby incorporated by reference for its disclosure of such compounds and salts, and methods for preparing such compounds and salts. A synthetic oil of the type described below is used in place of any mineral or natural oils used in the preparation of the salts for use in this invention.

In another embodiment, neutral or basic salts of the above-described phenols may be used in this invention. Preferably, the metal-containing phenol is a basic alkaline earth, more preferably calcium phenol. These salts are prepared by methods known to those in the art.

In another embodiment, the antioxidant (D) may be phenothiazine, substituted phenothiazines, or derivatives such as represented by Formula IV

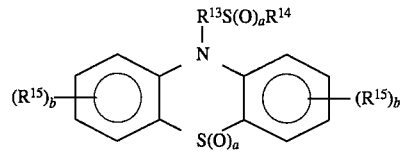

(IV)

wherein $R^{14}$ is selected from the group consisting of higher alkyl groups, or an alkenyl, aryl, alkaryl or aralkyl group and mixtures thereof; $R^{13}$ is an alkylene, alkenylene or an aralkylene group, or mixtures thereof; each $R^{15}$ is independently alkyl, alkenyl, aryl, alkaryl, arylalkyl, halogen, hydroxyl, alkoxy, alkylthio, arylthio, or fused aromatic rings, or mixtures thereof; a and b are each independently 0 or greater.

In another embodiment, the phenothiazine derivatives may be represented by Formula V

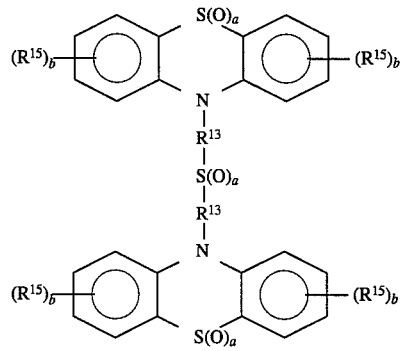

(V)

wherein $R^{13}$, $R^{14}$, $R^{15}$, a and b are as defined with respect to Formula IV.

The above-described phenothiazine derivatives, and methods for their preparation are described in U.S. Pat. No. 4,785,095, and the disclosure of this patent is hereby incorporated by reference for its teachings of such methods and compounds. In one embodiment, a dialkyldiphenylamine is treated with sulfur at an elevated temperature such as in the range of 145° C. to 205° C. for a sufficient time to complete the reaction. A catalyst such as iodine may be utilized to establish the sulfur bridge.

Phenothiazine and its various derivatives can be converted to compounds of Formula IV by contacting the phenothiazine compound containing the free NH group with a thio alcohol of the formula $R^{14}SR^{13}OH$ where $R^{14}$ and $R^{13}$ are defined with respect to Formula IV. The thioalcohol may be obtained by the reaction of a mercaptan $R^{14}SH$ with an alkylene oxide under basic conditions. Alternatively, the thio alcohol may be obtained by reacting a terminal olefin with mercaptoethanol under free radical conditions. The reaction between the thioalcohol and the phenothiazine compound generally is conducted in the presence of an inert solvent such as toluene, benzene, etc. A strong acid catalyst such as sulfuric acid or para-toluene sulfonic acid at about 1 part to about 50 parts of catalyst per 1000 parts of phenothiazine is preferred. The reaction is conducted generally at reflux temperature with removal of water as it is formed. Conveniently, the reaction temperature may be maintained between 80° C. and 170° C.

When it is desired to prepare compounds of the type represented by Formulae IV and V wherein x is 1 or 2, i.e., sulfones or sulfoxides, the derivatives prepared by the reaction with the thio alcohols described above are oxidized with an oxidizing agent such as hydrogen peroxide in a solvent such as glacial acetic acid or ethanol under an inert gas blanket. The partial oxidation takes place conveniently at from about 20° C. to about 150° C. The following examples illustrate the preparation of phenothiazines which may be utilized as the non-phenolic antioxidant (D) in the functional fluids of the present invention.

EXAMPLE D-10

One mole of phenothiazine is placed in a one-liter, round bottom flask with 300 ml. of toluene. A nitrogen blanket is maintained in the reactor. To the mixture of phenothiazine and toluene is added 0.05 mole of sulfuric acid catalyst. The mixture is then heated to reflux temperature and 1.1 moles of n-dodecylthioethanol is added dropwise over a period of approximately 90 minutes. Water is continuously removed as it is formed in the reaction process.

The reaction mixture is continuously stirred under reflux until substantially no further water is evolved. The reaction mixture is then allowed to cool to 90° C. The sulfuric acid catalyst is neutralized with sodium hydroxide. The solvent is then removed under a vacuum of 2 KPa at 110° C. The residue is filtered giving a 95% yield of the desired product.

In another embodiment, the antioxidant (D) is a transition metal-containing composition. The transition metal-containing antioxidant is oil-soluble. The compositions generally contain at least one transition metal selected from titanium, manganese, cobalt, nickel, copper, zinc, preferably manganese, copper, zinc, more preferably copper. The transition metal-containing composition is generally in the form of a metal-organic compound complex. The organic compounds include carboxylic acids and esters, mono- and dithiophosphoric acids, dithiocarbamic acids and dispersants. Generally, the transition metal-containing compositions contain at least about 5 carbon atoms to render the compositions oil-soluble.

In one embodiment, the organic compound is a carboxylic acid. The carboxylic acid may be a mono- or polycarboxylic acid containing from 1 to about 10 carboxylic groups and 2 to about 75 carbon atoms, preferably 2 to about 30, more preferably 2 to about 24. Examples of monocarboxylic acids include 2-ethylhexanoic acid, octanoic acid, decanoic acid, oleic acid, linoleic acid, stearic acid and gluconic acid. Examples of polycarboxylic acids include succinic, malonic, citraconic acids as well as substituted versions of these acids. The carboxylic acid may be one of the above-described hydrocarbyl-substituted carboxylic acylating agents.

In another embodiment, the organic compound is a mono- or dithiophosphoric acid. The dithiophosphoric acids may be any of the above-described phosphoric acids (see dihydrocarbyl dithiophosphate). A monothiophosphoric acid is prepared by treating a dithiophosphoric acid with steam or water.

In another embodiment, the organic compound is a mono- or dithiocarbamic acid. Mono- or dithiocarbamic acid is prepared by reacting carbon disulfide or carbon oxysulfide with a primary or secondary amine. The amines may be any of the amines described above.

In another embodiment, the organic compound may be any of the phenols, aromatic amines, or dispersants described above. In a preferred embodiment, the transition metal-containing composition is a lower carboxylic acid-transition metal-dispersant complex. The lower alkyl carboxylic acids contain from 1 to about 7 carbon atoms and include acetic, propionic, butanoic and 2-ethylhexanoic acid. The dispersant may be any of the dispersants described above, preferably the dispersant is a nitrogen-containing carboxylic dispersant. The transition metal complex is prepared by blending a lower carboxylic acid salt of a transition metal with a dispersant at a temperature from about 25° C. to about 100° C. A solvent such a xylene, toluene, naphtha or mineral oil may be used.

EXAMPLE D-11

The metal complex is obtained by heating at 160° C. for 32 hours 50 parts of copper diacetate monohydrate, 283 parts of 100 neutral mineral oil, 250 milliliters of xylene and 507 parts of an acylated nitrogen intermediate prepared by reacting 4,392 parts of a polybutene-substituted succinic anhydride (prepared by the reaction of a chlorinated polybutene having a number average molecular weight of 1000 and a chlorine content of 4.3% and 20% molar excess of maleic anhydride) with 540 parts of an alkylene amine polyamine mixture of 3 parts by weight of triethylene tetramine and 1 part by weight of diethylene triamine, and 3240 parts of 100 neutral mineral oil at 130° C.–240° C. for 3.5 hours. The reaction is vacuum stripped to 110° C. and 5 millimeters of mercury. The reaction is filtered through diatomaceous earth to yield a filtrate which has 59% by weight oil, 0.3% by weight copper and 1.2% by weight nitrogen.

EXAMPLE D-12

(a) A mixture of 420 parts (7 moles) of isopropyl alcohol and 518 parts (7 moles) of n-butyl alcohol is prepared and heated to 60° C. under a nitrogen atmosphere. Phosphorus pentasulfide (647 parts, 2.91 moles) is added over a period of one hour while maintaining the temperature at 65°–77° C. The mixture is stirred an additional hour while cooling. The material is filtered through a filter aid, and the filtrate is the desired phosphorodithioic acid.

(b) A mixture of 69 parts (0.97 equivalent) of cuprous oxide and 38 parts of mineral oil is prepared and 239 parts (0.88 equivalent) of the phosphorordithioic acid prepared in Example D-13(a) are added over a period of about 2 hours. The reaction is slightly exothermic during the addition, the mixture is thereafter stirred for an additional 3 hours while maintaining the temperature at about 70° C. The mixture is stripped to 105° C./10 mm. Hg. and filtered. The filtrate is a dark-green liquid containing 17.3% copper.

Lubricating Compositions

Lubricating compositions of the present invention are effective in lubricating compression and spark-ignited engines, preferably spark-ignited. The compositions of the present invention provide effective protection to engines under operating conditions. As described above, the lubricating compositions comprise a major amount of an oil of lubricating viscosity and (A) at least one alkali metal overbased salt of a sulfonic, carboxylic or phosphorus acid or derivatives thereof, (B) at least one dispersant, (C) at least one metal dihydrocarbyl dithiophosphate, and (D) at least one antioxidant.

The lubricating compositions and methods of this invention employ an oil of lubricating viscosity, including natural or synthetic lubricating oils and mixtures thereof. Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of dicarboxylic acids and polyols, esters of phosphorus-containing acids, polymeric tetrahydrofurans and silcon-based oils.

Specific examples of the oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by D. V. Brock, "Lubricant Oils", *Lubricant Engineering*, volume 43, pages 184–185, March, 1987. This article is herein incorporated by reference for its disclosures relating to lubricating oils. A description of oils of lubricating viscosity occurs in U.S. Pat. No. 4,582,618 (column 2, line 37 through column 3, line 63, inclusive), herein incorporated by reference its disclosure to oils of lubricating viscosity.

The above components are generally present in amounts to provide effective protection to the engines. The alkali metal salt (A) is present in an amount to provide at least about 0.0050 equivalent of alkali metal per 100 grams of lubricating composition, preferably at least about 0.0056, more preferably at least about 0.0063, and still more preferably at least about 0.0069 or about 0.0075. Generally, the alkali metal salt (A) is present in an amount to provide up to about 0.025 equivalent of alkali metal per 100 grams of lubricating composition, preferably up to about 0.019, more preferably up to about 0.0125. In another embodiment, the alkali metal salt (A) is present in an amount from at least about 0.40% by weight of the composition, preferably at least about 0.45%, more preferably at least about 0.50%, still more preferably at least about 0.55%. Generally, the alkali metal salt (A) is present in an amount up to about 2.0% by weight of the composition, preferably up to about 1.5%, more preferably up to about 1.0%.

The dispersant (B) is generally present in an amount of at least about 1.13%, preferably at least about 1.60%, more preferably at least about 1.80%, still more preferably at least about 2.25% by weight of the composition. The dispersant (B) is generally present in an amount up to about 5.0%, preferably up to about 4.0%, more preferably up to about 3.5% by weight of the composition. The metal hydrocarbyl dithiophosphate (C) is generally present in an amount from about 0.1%, preferably about 0.5%, more preferably about 0.7% up to about 2.0%, preferably up to about 1.75%, more preferably up to about 1.5% by weight of the composition. The antioxidant (D) is generally present in an amount from about 0.01%, preferably from about 0.03% up to about 2.0%, preferably up to about 1.0% by weight of the composition. In another embodiment, the antioxidant is present in an amount to provide about 50, preferably about 100, more preferably about 125 up to about 2000, generally up to about 1000, preferably up to about 500, preferably up to about 250, more preferably up to about 150 ppm transition metal to the lubricating composition.

The lubricating compositions of the present invention are free of calcium overbased sulfonate. The use of the term "free of" refers to compositions which are substantially free of calcium overbased sulfonate. In another embodiment, the compositions are free of calcium overbased phenates, including calcium overbased alkylene-coupled phenates and calcium overbased sulfur-coupled phenates. In another embodiment, the compositions are free of magnesium overbased sulfonates. The metal ratio of the magnesium and calcium overbased sulfonates is typically 1.5 to 40. The lubricating compositions of the present invention generally contain less than about 0.08% by weight calcium, preferably less than about 0.07%, more preferably less than about 0.05%, still more preferably less than 0.01%. Some calcium may be present in some of the additives of the present invention as a contaminant. These small quantities of calcium are acceptable provided they do not adversely affect the compositions of the present invention. In another embodiment, the lubricating compositions contain less than about 0.08% by weight magnesium, preferably less than about 0.05%, more preferably less than about 0.01%. Some magnesium may be present in some of the additives of the present invention as a contaminant. These small quantities of magnesium are acceptable provided they do not adversely affect the compositions of the present invention.

The lubricating compositions of the present invention may be used, by themselves or in combination with any other known additive which includes, but is not limited to anti-wear agents, extreme pressure agents, emulsifiers, demulsifiers, friction modifiers, anti-rust agents, corrosion inhibitors, foam inhibitors, viscosity improvers, pour point depressants and dyes. These additives may be present in various amounts depending on the needs of the final product.

Corrosion inhibitors, extreme pressure and anti-wear agents include but are not limited to metal salts of a phosphorus acid, chlorinated aliphatic hydrocarbons; phosphorus esters including dihydrocarbyl and trihydrocarbyl phosphites; boron-containing compounds including borate esters; dimercapto-thiadiazole derivatives; benzotriazole derivatives; amino mercapto thiadiazoles; and molybdenum compounds.

Viscosity improvers include but are not limited to polyisobutenes, polymethyacrylate acid esters, polyacrylate acid esters, diene polymers, polyalkyl styrenes, alkenyl aryl conjugated diene copolymers (preferably, styrene-maleic anhydride copolymer esters), polyolefins and multifunctional viscosity improvers.

Pour point depressants are a particularly useful type of additive often included in the lubricating oils described herein. See for example, page 8 of "Lubricant Additives" by C. V. Smalheer and R. Kennedy Smith (Lesius-Hiles Company Publishers, Cleveland, Ohio, 1967).

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

These and other additives are described in greater detail in U.S. Pat. No. 4,582,618 (column 14, line 52 through column 17, line 16, inclusive), herein incorporated by reference for its disclosure of other additives that may be used in combination with the present invention.

The lubricating compositions of the present invention are prepared by blending components (A)–(D) above with or without additional optional additives in an oil of lubricating viscosity. Blending is accomplished by mixing (usually by stirring) the ingredients from room temperature up to the decomposition temperature of the mixture or individual components. Generally, the ingredients are blended at a temperature from about 25° C. up to about 250° C., preferably up to about 200° C., more preferably up to about 150° C., still more preferably up to about 100° C.

The following tables contain examples which illustrate lubricants of the present invention. "Bal." in the table represents that the balance of the composition is oil. The amount of each component in Examples A–J is measured in volume percent and reflects the amount of oil containing products of the indicated additives.

| Product of Example: | Lubricants (% by volume) | | | | |
|---|---|---|---|---|---|
| | A | B | C | D | E |
| A-1 | 0.6 | 0.6 | 0.6 | 0.6 | — |
| A-5 | — | — | — | — | 0.6 |
| B-1 | 5.5 | — | 5.5 | 5.5 | 5.5 |
| B-12 | — | 6.3 | — | — | — |
| C-1 | 0.75 | 0.75 | 0.45 | 0.82 | 0.75 |
| D-1 | — | 0.53 | — | — | — |
| D-5 | — | — | — | 0.41 | — |
| D-7 | — | — | 0.5 | — | 0.30 |
| Copper 0,0'-iso-propyl methyl-amyl dithiophosphate | 0.06 | — | 0.12 | — | 0.08 |
| Glycerol monooleate or oleyl amide | — | — | 0.1 | 0.1 | 0.1 |
| 8% Hydrogenated styrene-butadiene copolymer in 100 neutral mineral oil | 7.0 | 6.5 | 6.5 | 8.7 | 9.5 |
| Silicon antifoam agent | 80 ppm | 80 ppm | 80 ppm | 80 ppm | 80 ppm |
| Oil | Bal. | Bal. | Bal. | Bal. | Bal. |
| | F | G | H | I | J |
| A-1 | 0.6 | 0.6 | — | — | — |
| A-4 | — | — | 0.82 | 0.82 | 0.75 |
| B-1 | 5.5 | 5.5 | 6.3 | 6.3 | 6.0 |
| C-1 | 1.0 | 0.75 | 0.85 | 0.85 | 1.1 |
| D-6 | — | — | — | 0.37 | — |
| D-7 | — | — | 0.32 | — | — |
| Di(nonylphenyl) amine | — | — | — | — | 0.5 |
| Copper 0,0'-iso-propyl methyl-amyl dithiophosphate | 0.04 | 0.06 | 0.13 | 0.13 | — |
| Glycerol monooleate or oleyl amide | — | 0.1 | 0.1 | 0.1 | 0.1 |
| 8% Hydrogenated styrene-butadiene copolymer in 100 neutral mineral oil | 6.5 | 6.5 | 8.5 | 6.5 | 6.5 |
| Silicon antifoam agent | 80 ppm | 80 ppm | 80 ppm | 80 ppm | 80 ppm |
| Oil | Bal. | Bal. | Bal. | Bal. | Bal. |

The lubricating oil compositions of the present invention exhibit a reduced tendency to deteriorate under conditions of use and thereby reduce wear and the formation of such undesirable deposits as varnish, sludge, carbonaceous materials and resinous materials which tend to adhere to the various engine parts and reduce the efficiency of the engines. Lubricating oils also can be formulated in accordance with this invention which result in improved fuel economy when used in the crankcase of a passenger automobile.

While the invention has been explained in relation to its preferred embodiments, it is to be understood that various modifications thereof will become apparent to those skilled in the at upon reading the specification. Therefore, it is to be understood that the invention disclosed herein is intended to cover such modifications as fall within the scope of the appended claims.

We claim:

1. A lubricating oil composition, comprising: a major amount of an oil of lubricating viscosity; and (A) an amount of at least one alkali metal overbased salt of an acidic organic compound sufficient to provide at least about 0.005 equivalents up to about 0.025 equivalents of alkali metal per 100 grams of the lubricating composition;

(B) at least about 1.13% by weight up to about 5% by weight of at least one dispersant;

(C) at least one metal dihydrocarbyl dithiophosphate; and (D) at least one antioxidant, provided that the lubricating oil composition is free of calcium overbased sulfonate; provided that the composition contains less than about 0.08% by weight calcium; and provided that (C) and (D) are not the same.

2. The composition of claim 1, wherein the alkali metal of (A) is sodium, potassium or lithium.

3. The composition of claim 1, wherein the overbased salt (A) has a metal ratio from about 3 to about 40.

4. The composition of claim 1, wherein the acidic organic compound is a sulfonic acid, carboxylic acid, phosphorus acid or phenol or derivative thereof.

5. The composition of claim 1, wherein the overbased salt of (A) is a sodium or potassium overbased sulfonate.

6. The composition of claim 1, wherein the overbased salt of (A) is a sodium or potassium overbased carboxylate.

7. The composition of claim 6, wherein the carboxylate is a hydrocarbyl-substituted carboxylate wherein the hydrocarbyl group is derived from a polyalkene having an $\overline{M}n$ of about 400 to about 5,000.

8. The composition of claim 7, wherein the polyalkene has a $\overline{M}n$ of about 800 to about 2,500.

9. The composition of claim 1, wherein the overbased salt of (A) is a sodium or potassium overbased thiophosphonate.

10. The composition of claim 1, wherein the dispersant (B) is (a) at least one nitrogen-containing carboxylic dispersant, (b) at least one amine dispersant, (c) at least one ester dispersant, (d) at least one Mannich dispersant, (e) at least one dispersant viscosity improver, or (f) a mixture of two or more thereof.

11. The composition of claim 10, wherein the dispersant (B) is (a) at least one nitrogen-containing carboxylic dispersant prepared by reacting a hydrocarbyl-substituted carboxylic acylating agent, wherein the hydrocarbyl group is derived from a polyalkene having an $\overline{M}n$ of about 500 to about 5,000, with an amine having at least one primary or secondary amino group.

12. The composition of claim 11, wherein the polyalkene has an $\overline{M}n$ of about 800 to about 2,500.

13. The composition of claim 11, wherein the hydrocarbyl-substituted carboxylic acylating agent is a hydrocarbyl succinic acylating agent wherein the acylating agent has an average of at least 1.3 succinic groups for each equivalent weight of hydrocarbyl group and the hydrocarbyl group is derived from a polyalkene having an $\overline{M}n$ value of about 1300 to about 5000 and an $\overline{M}w/\overline{M}n$ value of about 1.5 to about 4.

14. The composition of claim 11, wherein the amine is an alkylene polyamine.

15. The composition of claim 10, wherein the dispersant (B) is (b) an ester dispersant prepared by the reaction of a hydrocarbyl-substituted carboxylic acylating agent, wherein the hydrocarbyl group is derived from a polyalkene having an $\overline{M}n$ of about 500 to about 5,000, with at least one polyhydroxy compound.

16. The composition of claim 15, wherein the polyhydroxy compound is a compound having from 2 to about 8 hydroxyl groups and from 2 to about 20 carbon atoms.

17. The composition of claim 15, wherein the polyhydroxy compound is pentaerythritol, trimethylolpropane, glycerol, sorbitol, ethylene glycol, tris(hydroxymethyl)aminomethane or dimers or trimers thereof.

18. The composition of claim 15, wherein the ester dispersant is further reacted with an amine.

19. The composition of claim 18, wherein the amine is an alkylene polyamine.

20. The composition of claim 1, wherein the metal dihydrocarbyl dithiophosphate (C) is at least one zinc dihydrocarbyl dithiophosphate.

21. The composition of claim 1, wherein the antioxidant (D) is at least one sulfur-containing composition, at least one alkylated aromatic amine, at least one phenol, at least one oil-soluble transition metal containing antioxidant or mixtures thereof.

22. The composition of claim 21, wherein the antioxidant (D) is an alkylene-coupled phenol having an alkylene group having 1 to about 8 carbon atoms.

23. The composition of claim 21, wherein the antioxidant (D) is a 2,6-di-t-alkyl-4-hydrocarbyl phenol.

24. The composition of claim 21, wherein the antioxidant (D) is at least one transition metal-containing antioxidant.

25. The composition of claim 24 wherein the transition metal is copper.

26. The composition of claim 21, wherein the antioxidant (D) is at least one copper dihydrocaryl dithiophosphate.

27. The composition of claim 1, further provided that the lubricating oil composition is free of overbased magnesium sulfonate.

28. The composition of claim 1, wherein the composition is free of sulfur-coupled phenol.

29. The composition of claim 1, wherein the lubricant is a spark ignited engine lubricant.

30. A lubricating oil composition, comprising: a major amount of an oil of lubricating viscosity; and (A) an amount of at least one sodium or potassium overbased salt of a sulfonic or carboxylic acid or derivative thereof sufficient to provide at least about 0.005 equivalents up to about 0.025 equivalents of sodium or potassium per 100 grams of lubricating composition;

(B) at least about 1.13% by weight up to about 5% by weight of at least one dispersant;

(C) at least one zinc dihydrocarbyl dithiophosphate; and (D) at least one antioxidant, provided that the lubricating oil composition is free of calcium overbased sulfonate; provided that (D) and (C) are not the same; and provided that the composition contains less than about 0.08% by weight calcium.

31. The composition of claim 30, wherein the dispersant (B) is (a) at least one nitrogen-containing dispersant, (b) at least one amine disperant, (c) at least one carboxylic ester dispersant, (d) at least one Mannich dispersant, (e) at least one dispersant viscosity improver, or (f) mixtures of two or more thereof.

32. The composition of claim 31, wherein the dispersant (B) is (a) at least one acylated nitrogen-containing dispersant prepared by reacting a hydrocarbyl-substituted carboxylic acylating agent, wherein the hydrocarbyl group is derived from a polyalkene having an $\overline{M}n$ of about 500 to about 5,000, with a polyamine.

33. The composition of claim 32, wherein the hydrocarbyl-substituted carboxylic acylating agent is a hydrocarbyl succinic acylating agent wherein the acylating agent has an average of at least 1.3 succinic groups for each equivalent weight of hydrocarbyl group and the hydrocarbyl group is derived from a polyalkene having an $\overline{M}n$ value of about 1300 to about 5000 and an $\overline{M}w/\overline{M}n$ value of about 1.5 to about 4.

34. The composition of claim 30, wherein the antioxidant (D) is at least one sulfur-containing composition, at least one alkylated aromatic amine, at least one phenol, or at least one transition metal-containing antioxidant.

35. The composition of claim 34, wherein the antioxidant (D) is a copper-containing antioxidant.

36. The composition of claim 34, wherein the antioxidant (D) is an alkylene-coupled phenol wherein the alkylene group contains from 1 to about 8 carbon atoms.

37. The composition of claim 32, wherein the antioxidant (D) is a 2,6-di-t-alkyl-4-hydrocarbyl phenol.

38. The composition of claim 30, further provided that the lubricating oil composition is free of over-based magnesium sulfonate.

39. The composition of claim 30, wherein the composition is free of sulfur coupled phenol.

40. The composition of claim 30, wherein the composition contains less than about 0.01% calcium and 0.01% magnesium.

41. The composition of claim 30, wherein the lubricant is a spark ignited engine lubricant.

42. A lubricating oil composition, comprising: a major amount of an oil of lubricating viscosity; and (A) an amount of at least one sodium overbased salt of an acidic organic compound sufficient to provide at least about 0.005 equivalents up to about 0.025 equivalents of alkali metal per 100 grams of the lubricating composition;

(B) at least about 1.13% by weight up to about 5% by weight of at least one dispersant;

(C) at least one metal dihydrocarbyl dithiophosphate; and (D) at least one copper-containing antioxidant, provided that the lubricating oil composition is free of calcium overbased sulfonate; provided that the composition contains less than about 0.08% by weight calcium; and provided that (C) and (D) are not the same.

43. A method comprising lubricating spark ignited or compression engines with the lubricating composition of claim 1.

44. A method comprising lubricating spark ignited or compression engines with the lubricating composition of claim 30.

45. A lubricating oil composition, prepared by blending: a major amount of an oil of lubricating viscosity with (A) an amount of at least one alkali metal overbased salt of an acidic organic compound sufficient to provide at least about 0.005 equivalents up to about 0.025 equivalents of alkali metal per 100 grams of the lubricating composition;

(B) at least about 1.13% by weight up to about 5% by weight of at least one dispersant;

(C) at least one dihydrocarbyl dithiophosphate; and (D) at least one antioxidant, provided that the lubricating oil composition is free of calcium overbased sulfonate; provided that the composition contains less than about 0.08% by weight calcium; and provided that (C) and (D) are not the same.

* * * * *